US005873073A

United States Patent [19]

Bresnan et al.

[11] Patent Number: 5,873,073

[45] Date of Patent: Feb. 16, 1999

[54] METHOD AND SYSTEM FOR MAIL PIECE PRODUCTION UTILIZING A DATA CENTER AND INTER-RELATED COMMUNICATION NETWORKS

[75] Inventors: Mark Bresnan, Newtown; Je H. Oh, Fairfield, both of Conn.

[73] Assignee: Pitney Bowes Inc., Stamford, Conn.

[21] Appl. No.: 772,787

[22] Filed: Dec. 24, 1996

[51] Int. Cl.[6] ..... G07B 17/00

[52] U.S. Cl. ..... 705/410; 364/478.08; 705/401; 707/500

[58] Field of Search ..... 364/400, 478.01, 364/478.07, 478.08, 478.11; 395/101, 114, 200.3; 705/400, 401, 408, 410; 707/500, 517, 518, 521

[56] References Cited

U.S. PATENT DOCUMENTS

| | | | |
|---|---|---|---|
| 4,731,048 | 3/1988 | Marella et al. | 493/188 |
| 4,800,505 | 1/1989 | Axelrod et al. | 364/478 |
| 4,831,555 | 5/1989 | Sansone et al. | 395/113 |
| 4,837,701 | 6/1989 | Sansone et al. | 705/404 |
| 4,908,770 | 3/1990 | Breault et al. | 705/440 |
| 4,941,091 | 7/1990 | Breault et al. | 705/30 |
| 5,051,914 | 9/1990 | Sansone et al. | 364/478.11 |
| 5,067,305 | 11/1991 | Baker et al. | 53/411 |
| 5,068,797 | 11/1991 | Sansone et al. | 364/478.07 |
| 5,072,401 | 12/1991 | Sansone et al. | 364/478.07 |
| 5,119,306 | 6/1992 | Metelits et al. | 705/406 |
| 5,142,482 | 8/1992 | Sansone | 364/478.09 |
| 5,161,109 | 11/1992 | Keating et al. | 705/410 |
| 5,270,938 | 12/1993 | Sansone et al. | 705/406 |
| 5,283,752 | 2/1994 | Gombault et al. | 364/478.09 |
| 5,434,961 | 7/1995 | Horiuchi et al. | 395/144 |
| 5,476,255 | 12/1995 | Murcko et al. | 271/109 |
| 5,504,743 | 4/1996 | Drefenstedt | 370/60.1 |
| 5,586,036 | 12/1996 | Pintsov | 705/408 |
| 5,602,742 | 2/1997 | Solondz et al. | 705/410 |
| 5,628,249 | 5/1997 | Cordery et al. | 101/91 |
| 5,684,706 | 11/1997 | Harmon et al. | 364/468.01 |
| 5,777,883 | 7/1998 | Lau et al. | 364/478.08 |
| 5,798,930 | 8/1998 | Van Osten | 364/478.01 |

*Primary Examiner*—Edward R. Cosimano
*Attorney, Agent, or Firm*—Melvin J. Scolnick; Charles R. Malandra

[57] ABSTRACT

The invention is a method for producing a finished mail piece. The method allows a system user to select at a first node, a plurality of characteristics which define a mailing. These characteristics include selection of a document to be printed at a terminal node and a list of addresses to which the printed document will be sent. Once selections have been made, the print job is transmitted to a terminal node which comprises a data processor, an envelope printer, and a document printer among other elements. The document printer will print the document in accordance with the characteristics selected at the first node; and, the envelope printer will print addresses from the address list to corresponding envelopes. Once the document has been printed, it is inserted into the envelope by inserting means to form an unfinished mail piece. The unfinished mail piece is sealed and then franked with appropriate postage in order to form a finished mail piece. The mail piece is then placed into a mail stream for delivery to the destination address. A receipt indicative of the print job and delivery into the mail stream may be optionally generated by the terminal node and transmitted to the first node. Several nodal layers can be created such that the first node can transmit the print job to a second node which can further transfer the print job to subsequent nodes for printing and routing.

19 Claims, 30 Drawing Sheets

MAILING MACHINE
ADDRESSING PRINTER
DOCUMENT PRINTER
SYSTEM FILE SERVER
SYSTEM SWITCH
MONITOR
MICRO-PROCESSOR
MODEM
KEYBOARD
PRINTER
MEMORY
5
10
12
14
16
18
20
22
24(a)
24(b)
24(c)
24(d)
24(e)
26
30
32
34
35
36
38
40

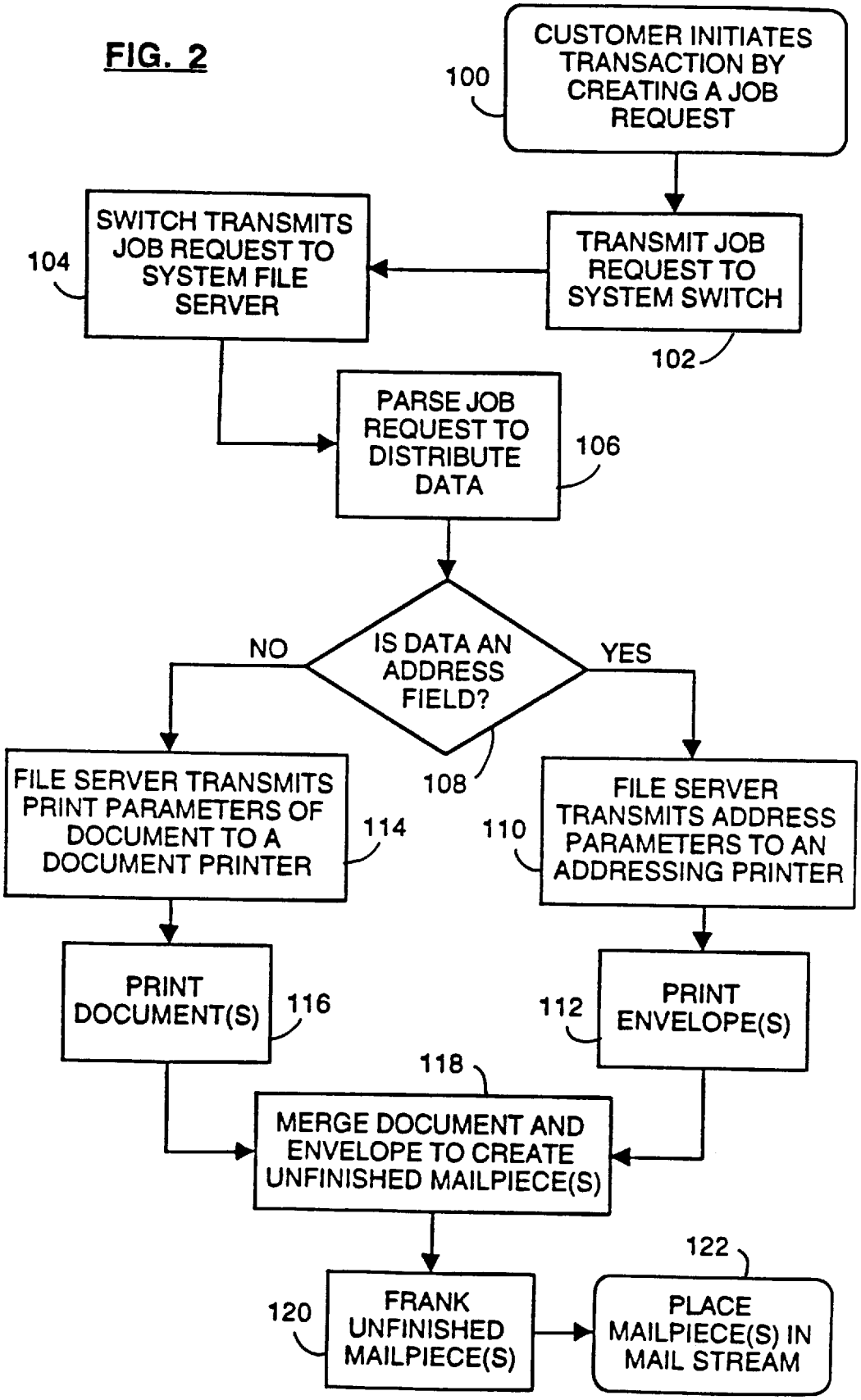
FIG. 2
CUSTOMER INITIATES TRANSACTION BY CREATING A JOB REQUEST
100
TRANSMIT JOB REQUEST TO SYSTEM SWITCH
102
SWITCH TRANSMITS JOB REQUEST TO SYSTEM FILE SERVER
104
PARSE JOB REQUEST TO DISTRIBUTE DATA
106
IS DATA AN ADDRESS FIELD?
108
NO
YES
FILE SERVER TRANSMITS PRINT PARAMETERS OF DOCUMENT TO A DOCUMENT PRINTER
114
FILE SERVER TRANSMITS ADDRESS PARAMETERS TO AN ADDRESSING PRINTER
110
PRINT DOCUMENT(S)
116
PRINT ENVELOPE(S)
112
MERGE DOCUMENT AND ENVELOPE TO CREATE UNFINISHED MAILPIECE(S)
118
FRANK UNFINISHED MAILPIECE(S)
120
PLACE MAILPIECE(S) IN MAIL STREAM
122

C5
376
CONTINUE?
NO
378
DONE?
NO
380
PRESS "CANCEL"
YES
YES
ADVANCE TO DOCUMENT INFORMATION SCREEN
386
PRESS "DONE" TO SAVE ENTRIES
382
RETURN TO MAIN MENU
384
DISPLAY DOCUMENT INFORMATION
388
SELECT DOCUMENT FILE
390
392
SELECT "SIMPLEX" OR "DUPLEX" PRINTING
INDICATE NUMBER OF SIDES TO BE PRINTED
394
SELECT PAPER COLOR
396
398
SELECT FOLD TYPE
SELECT PAPER SIZE
400
C6

METHOD AND SYSTEM FOR MAIL PIECE PRODUCTION UTILIZING A DATA CENTER AND INTER-RELATED COMMUNICATION NETWORKS

RELATED APPLICATIONS

Reference is made to application Ser. No. 08/772,798, entitled CHANNEL SWITCHED MAIL MESSAGE SWITCHING AND METERING SYSTEM, assigned to the assignee of this application and filed on even date herewith and now U.S. Pat. No. 5,802,503 issued Sep. 1, 1998 to Ronald P. Sansone.

Reference is made to application Ser. No. 08/772,788, entitled A METHOD AND SYSTEM FOR WORLDWIDE MEDIA SELECTION, PRODUCTION, AND DELIVERY, assigned to the assignee of this application and filed on even date herewith.

Reference is made to application Ser. No. 08/772,790, entitled A METHOD AND SYSTEM OF ACCOUNTING FOR TRANSACTION COSTS AND CURRENCY EXCHANGE IN A HYBRID MAIL SYSTEM, assigned to the assignee of this application and filed on even date herewith with a Notice of Allowance issued therefore on Jul. 21, 1998.

BACKGROUND OF THE INVENTION

The expansion of computer networking, and both the hardware and software that support it, has allowed a proliferation of new services to become available to network users. And, as a better understanding of networking has evolved, so too have the opportunities that are the outgrowth of such technology as the InterNet and the World Wide Web. These technologies allow increased service capability by offering users a chance to participate in marketing and service ventures that they would not normally be able to access due to constraints from expense, equipment, or size.

Small businesses in particular can benefit from the ability to utilize the equipment of a centralized data center; equipment that the small business could never cost-justify if it had to be purchased directly. Direct mail or mass mailings are an example of how an excellent marketing tool can be cost-justified by firms that utilize the tool only once or twice a year. The limited usage does not justify the expense of maintaining the mailing, shipping or print equipment in-house; yet, through networks such as the InterNet and World Wide Web small businesses can create a mailing and then download the mailing parameters to a data center that can assemble the mailing and utilize efficient, high speed systems to produce a finished mail piece. Thus, the creation of the hybrid mail piece.

Hybrid mail is a creature of the evolution of technology and the mail stream. Where once a mail piece was created locally and then dropped into the closest available mailbox for eventual delivery to a remote location, now the entry points into the mail stream are virtually unlimited. One of the key elements to the importance hybrid mail is the ability of the user to get the finished mail piece to its intended destination not just more quickly, but also at a cheaper cost.

The prior art has been limited to the services available from print shops that produce the printed document, or fulfillment houses that assemble and mail documents, brochures, or direct mail pieces. Those few that have merged their services to form fulfillment services with printing and mailing capability, still required at the very best, that a document be downloaded for printing at the remote site from the network. But, the ability to define the parameters of the mailing, and include the parameters within the mailing data coming from the initiating site, simply do not exist. Thus, a disadvantage of the prior art is that there has not been an effective marriage of the various art forms required to adequately create a mailing and a corresponding address list, fully define the parameters of the mailing, remotely produce the mailing, and then prepare the mailing for delivery to the mail stream as a set of finished mail pieces.

Thus, an objective of the present invention is to define a mail piece remotely, download the defined mail piece to a terminal site, and then provide a cost effective means of producing and then delivering the finished mail piece to its ultimate destination.

SUMMARY OF THE INVENTION

According to the invention, the object is achieved and the disadvantages of the prior art are overcome by a method for producing a finished mail piece.

The method allows a system user to select at a first node, a plurality of characteristics which define a mailing. These characteristics include selection of a document to be printed at a terminal node and a list of addresses to which the printed document will be sent. Additionally, the characteristics include a choice of: paper type; ink color; paper color; paper size; duplex or simplex printing on the chosen paper; a choice of whether or not a reply envelope is to be printed; and, a choice of how the chosen paper is to be folded. Once selections have been made, the print job is transmitted to a terminal node which comprises a data processor, an envelope printer, and a document printer among other elements. The document printer will print the document in accordance with the characteristics selected at the first node; and, the envelope printer will print addresses from the address list to corresponding envelopes. The two printers can be co-located as in certain applications that utilize an integrated mailing system; or, the printers can be in separate locations.

Once the document has been printed, the document is inserted into the envelope by inserting means to form an unfinished mail piece. The unfinished mail piece is sealed and then franked with appropriate postage in order to form a finished mail piece. The mail piece is then placed into a mail stream for delivery to the destination address. A receipt indicative of the print job and delivery into the mail stream may be optionally generated by the terminal node and transmitted to the first node. An feature available is the use of postal coding and duplicate detection as applied to the address list.

Several nodal layers can be created such that the first node can transmit the print job to a second node which can further transfer the print job to subsequent nodes for printing and routing. The use of more than one nodal layer allows a terminal node to be selected based upon convenience, scheduling, downtime, or location.

BRIEF DESCRIPTION OF THE DRAWINGS

FIG. 2 is a high level flowchart of the invention method.

DETAILED DESCRIPTION OF THE PREFERRED EMBODIMENTS

Figure 1:
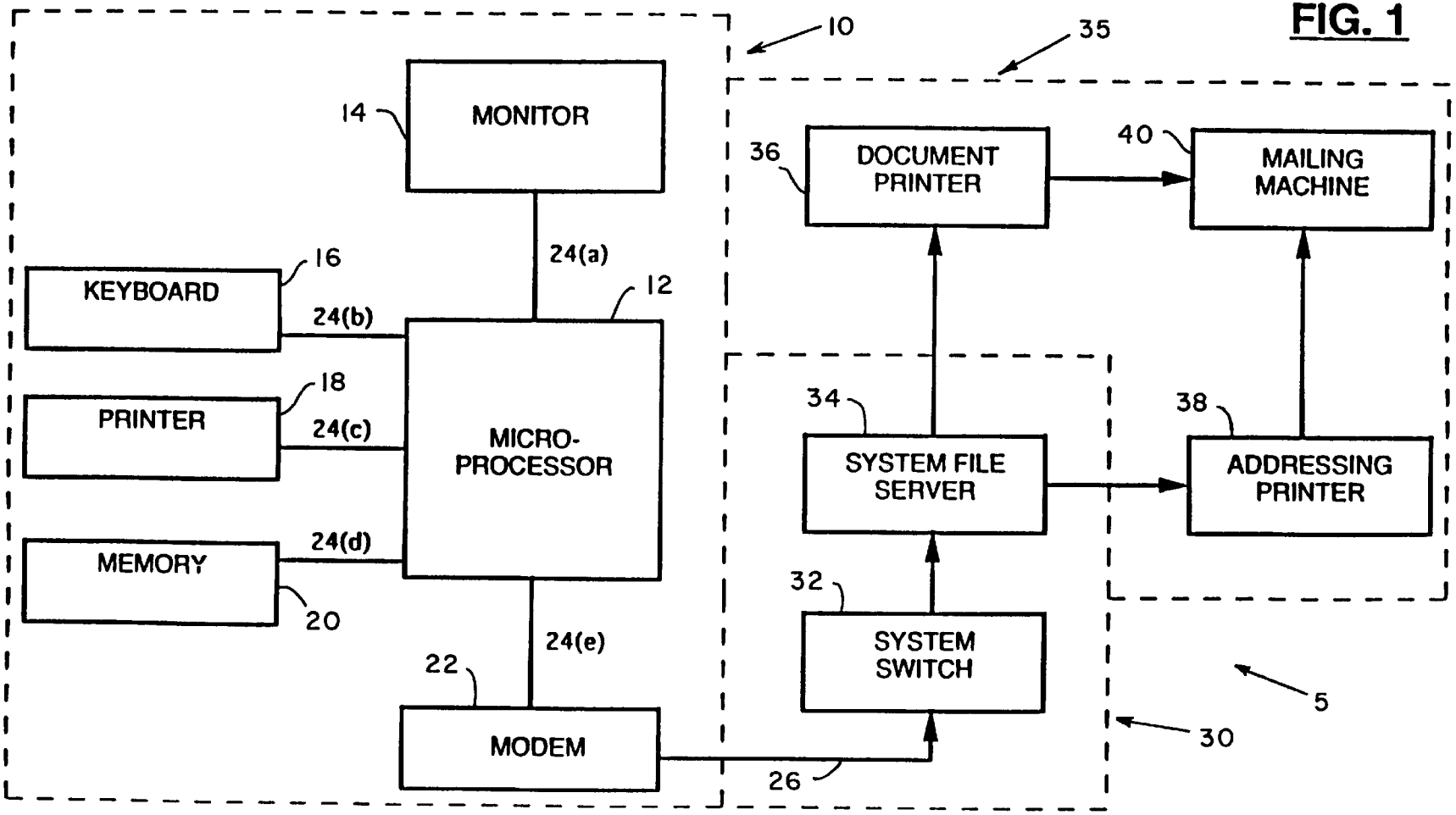
FIG. 1 is a block diagram of the system elements.

Turning to FIG. 1, system 5 which is representative of a preferred embodiment of a system that would employ the inventive method, is shown which is comprised of three subsystems. The subsystems are designated as: 10; 30; and 35.

Subsystem 10 represents the system's initiating node. Subsystem 10 node further comprises: microprocessor 12 for processing data assembled and/or created at the initiating node and for supporting the software program which comprises the system method; microprocessor 12 is connected to monitor 14 by cable 24(*a*), thus providing a visual interface between the system and the system user; keyboard 16 connected to microprocessor 12 by cable 24(*b*) for data entry and user interface with the system; printer 18 for printing reports and addressing data is connected to microprocessor 12 by interface cable 24(*c*); memory 20 for storing data is attached to microprocessor 12 by interface cable 24(*d*); and, modem 22 for communicating data to other nodes or subsystems is connected to microprocessor 12 by interface cable 24(*e*).

Subsystem 30 receives data from subsystem 10 via data link 26 which connects system switch 32 with modem 22 of the initiating node. Data is received at system switch 32 which determines the optimal routing for the data and then delivers the data to system file server 34 which further directs data to the appropriate devices comprising subsystem 35.

Subsystem 35 comprises: document printer 36 which receives document data from system file server 34; addressing printer 38 which receives address data from system file server 34; and, mailing machine 40 for preparing a finished mail piece.

Turning to FIG. 2, there begins a high level flowchart of the overall inventive method. The system method begins at step 100 where the system user or customer initiates a transaction by entering the software program being run on microprocessor 12 and whose user interface is displayed on monitor 14. The system user creates a job request thus designating the user's location, subsystem 10, as the initiating node. The job request is transmitted to system switch 32 at step 102 via modem 22. From step 102 the flow advances to step 104 where system switch 32 transmits the job request to system file server 34. The flow then advances to step 106 where system file server 34 will parse the data received from system switch 32.

Parsing is performed at step 106 so that address data and document data can be separated and formatted for delivery to its proper destination. To accomplish the accurate delivery of data, the method advances to step 108 and queries as to whether or not the data presented is an address field. If the answer to the query is "YES," then the method advances to step 110 where the file server transmits the address parameters, which may include barcoding, to an addressing printer. The addressing printer receives the address data and then prints the data to envelopes, or other appropriate media at step 112. From step 112, the method advances to step 118. If the response to the query at step 108 is "NO" however, then the method advances to step 114 where the file server determines that the data is document data and transmits the print parameters of the document to a document printer or printers for printing at step 116. From step 116, the method advances to step 118.

At step 118, the printed document is merged with the printed envelope to create an unfinished mailpiece. A number of different actions can be accomplished at this step. The printed media is manually or automatically inserted into the appropriate envelope, the envelopes can be stacked by stackers or redirected via transport means, weighed, and, the unfinished mailpiece can be sealed by a sealer if required. From step 118, the method advances to step 120 where the unfinished mailpiece is franked with appropriate postage by a postage meter and then placed into the mail stream at step 122.

Figure 3A:
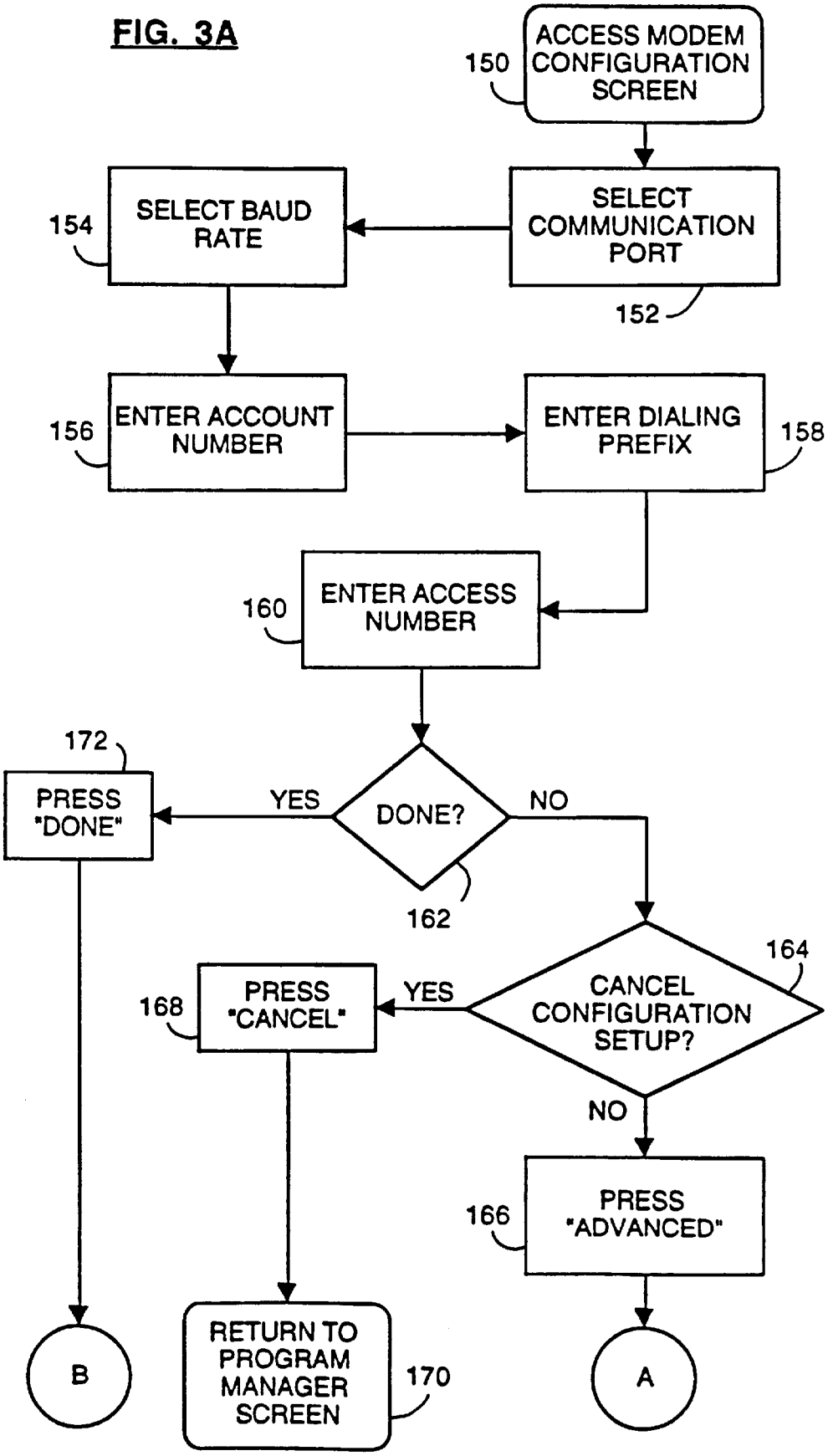
FIGS. 3A through 3D is a series of flowcharts that details the configuration setup and steps required to access the data center.

The method flow which was broadly outlined in FIG. 2 hereinabove, is presented in detail by FIGS. 3A through 7. Turning to FIG. 3A, there are shown the steps for setup of the system configuration parameters. Beginning at step 150, the system user accesses the modem configuration screen; the method then advances to step 152 where the communication port for the modem is selected. Systems, such as system 5, may have more than one available port for providing flexibility in interfacing communication devices. From step 152, the method advances to step 154 where the highest baud rate capability of the modem that is connected to the port selected in step 152 is entered into the system configuration. If the system user has registered the access software with the system administrator, then the system displays a predetermined account number at step 156; otherwise the account number field will be blank. The system user then enters a dialing prefix at step 158; the dialing prefix is whatever number is necessary for the system to dial in order to gain access to an outside phone line. From step 158, the system advances to step 160. At step 160, the system user enters the telephone number that the system must dial to access the system switch at the receiving node; if a list of possible destinations is available then the system user would access the list and select the appropriate destination. The system then advances to a query at step 162.

The system queries at step 162 as to whether or not the configuration entry is complete. If the response to the query is "YES," then the system operator indicates "DONE" at step 172. From step 172, the method advances along path B to step 240 as shown in FIG. 3D. If, however, the response to the query at step 162 is "NO," then the method advances to a query at step 164.

At step 164, the method queries as to whether or not the system user wants to cancel the configuration setup. If the response to the query is "YES," then the method advances to step 168 where the user selects "CANCEL." The system then returns the user to the program manager screen at step 170. If, however, the response to the query at step 164 is "NO," then the system user, at step 166, selects "ADVANCED." From step 166, the method advances along path A to step 200 as shown in FIG. 3B.

Figure 3B:
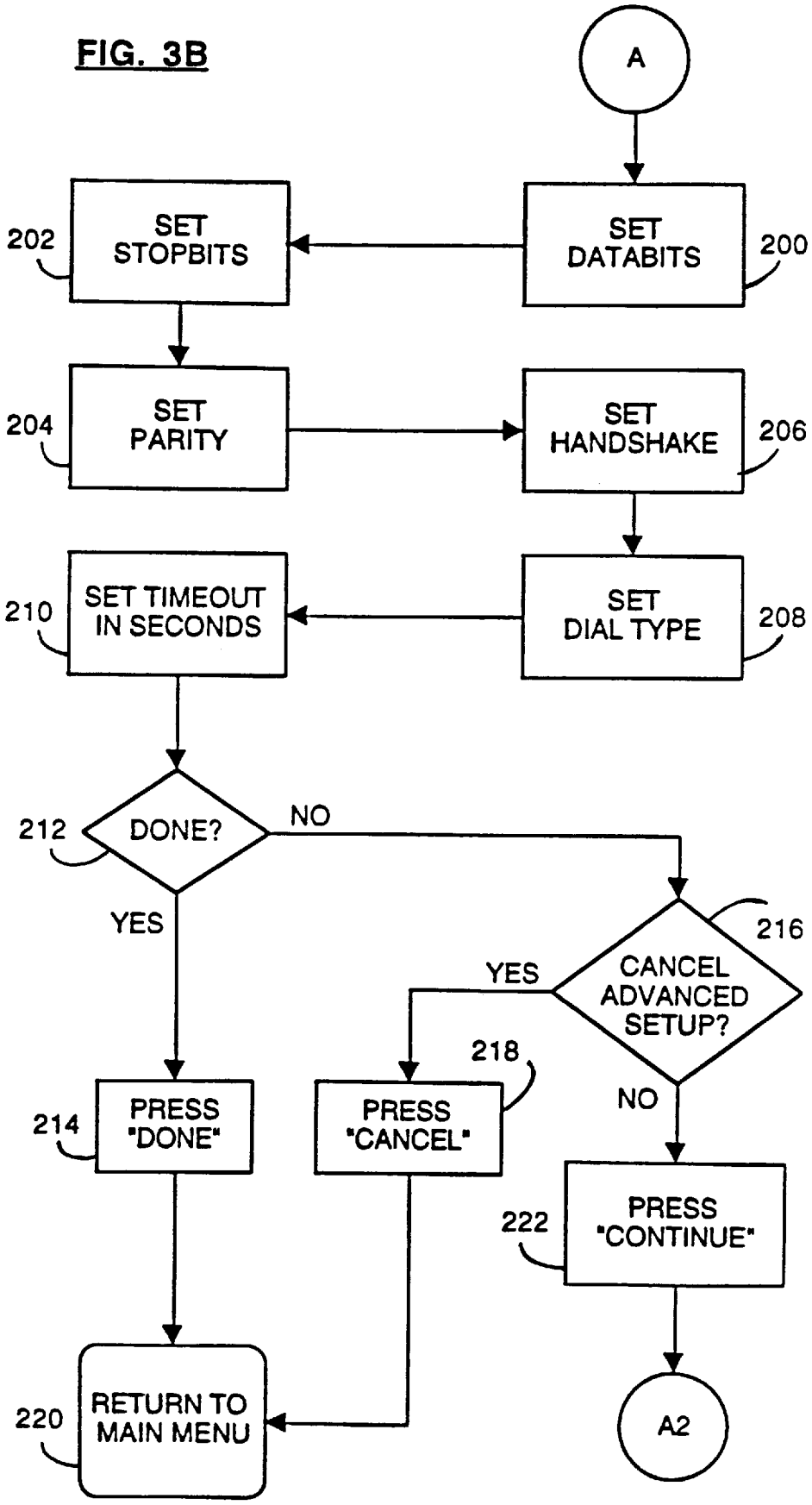

At step 200, in FIG. 3B, an Advanced Modem Setup screen is displayed to the system user and the user selects the data parameters beginning with the databit setting. The databit field specifies the word size of data (usually 8 bits) transmitted to the receiving node. The method then advances to step 202 where the system user sets the stop bits which are used for delimiting each word determined by the databit setup. From step 202, the method advances to step 204 where parity is set. The parity field specifies the parity checking on data sent to the receiving node. The method then advances to step 206 where the interface "handshake" is set which specifies the data flow control mechanism. Once the data parameters are determined, the method requests that the dial type be set at step 208 and that the handshake time-out be set at step 210. Dial type refers to whether the phone will be dialed using pulse dialing or multifrequency dialtone (DTMF); whereas, time-out refers to the length of delay in establishing the interface between the initiating node and the receiving node. After step 210, the method will advance to a query at step 212.

At step 212, the method queries as to whether or not the Advanced Modem Setup is complete. If the response to the query is "YES," then system user presses "DONE" at step 214 and is returned at step 220 to the Main Menu. However, if the response to the query at step 212 is "NO," then the method advances to the query at step 216. At step 216, the method queries as to whether or not the advanced setup is to be cancelled. If the response to the query is "NO," then the system user presses "CONTINUE" and the method advances along path A2 to step 224 in FIG. 3C. If the response to the query at step 216 is "YES," however, then the system user selects "CANCEL" at step 218 and the system returns to the Main Menu at step 220 without saving any changes.

Figure 3C:
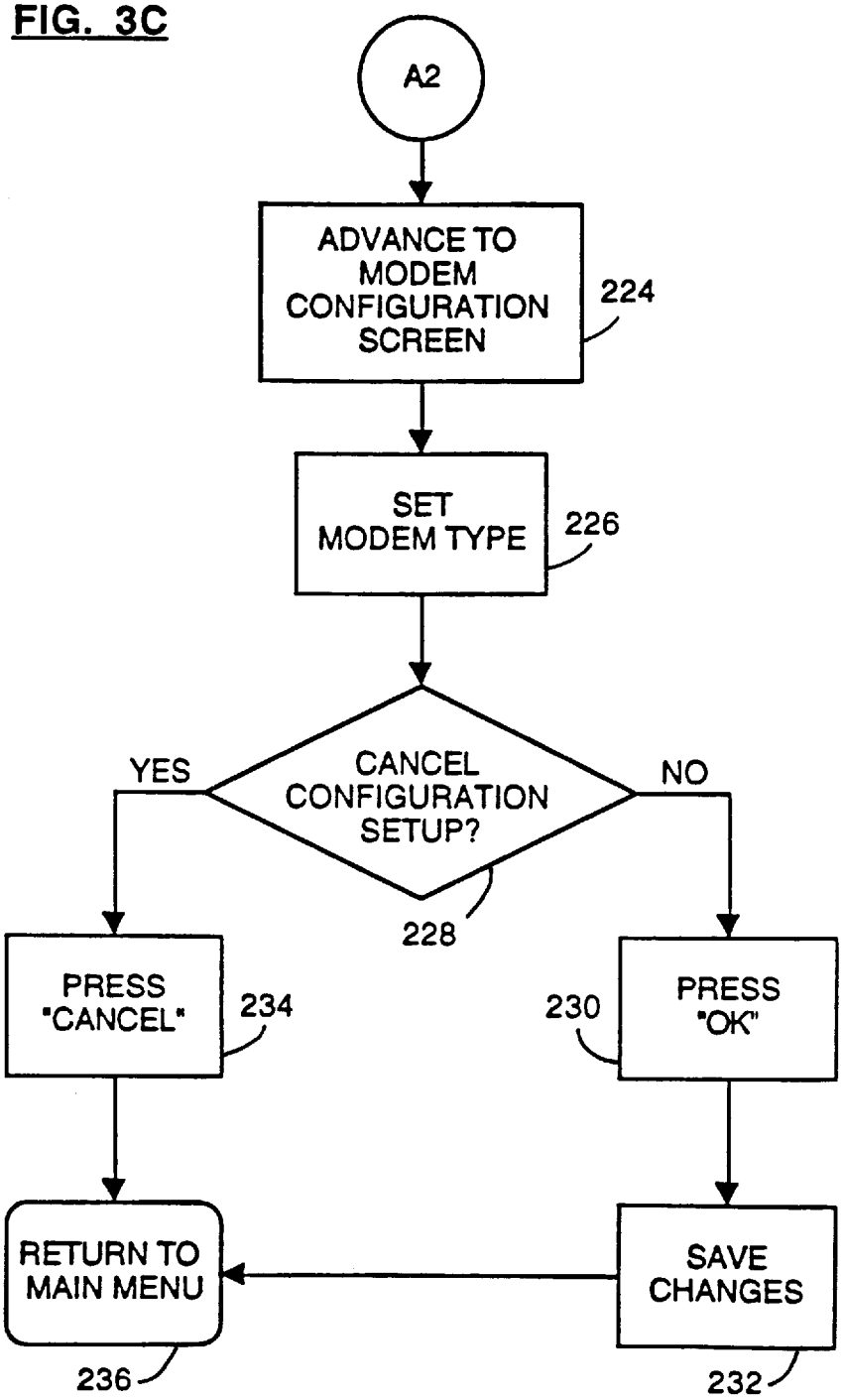
Figure 3D:
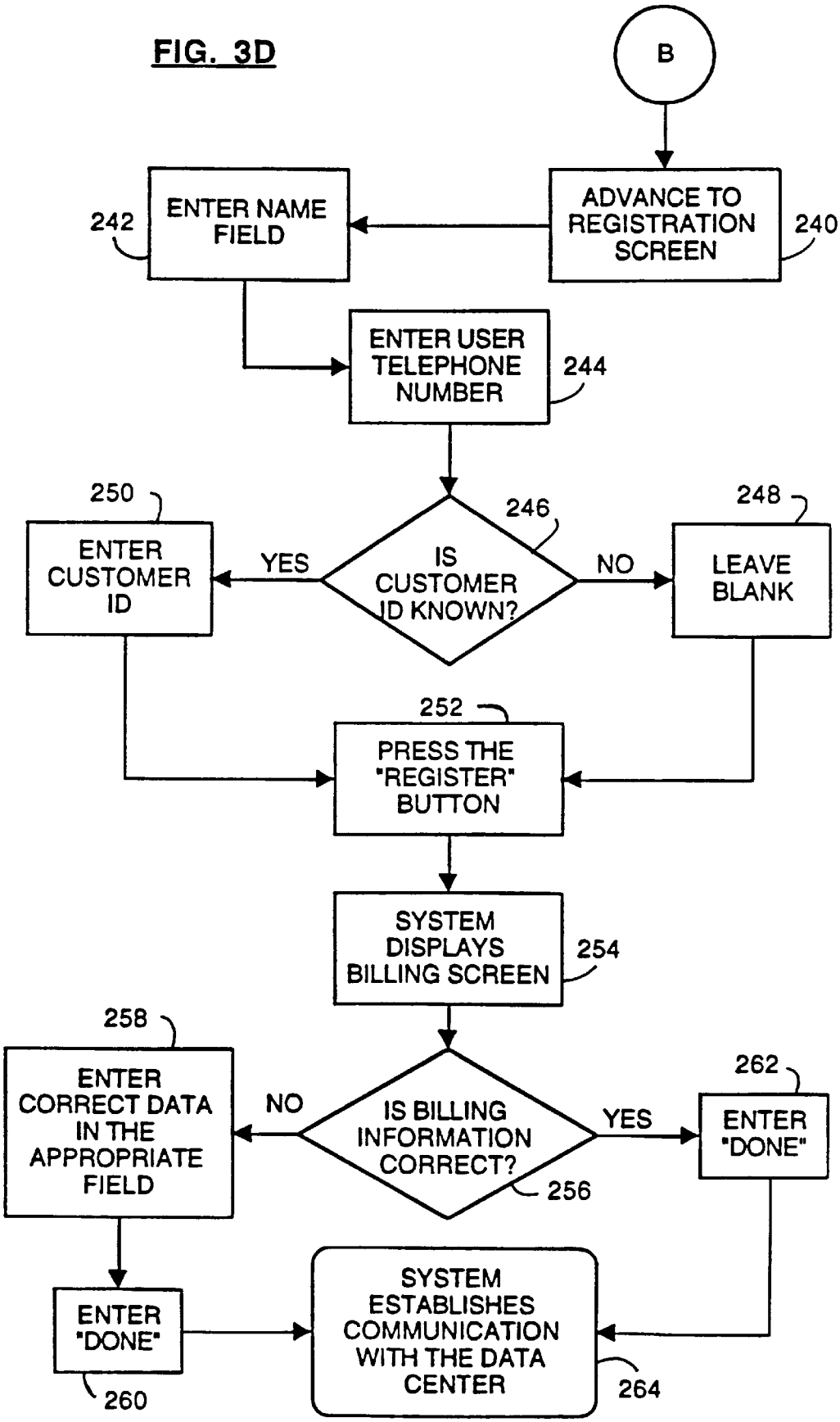

Turning to FIG. 3C, path A2 is shown re-entering at step 224 where the Modem Configuration screen is displayed to the system user. By interacting with the display, at step 226 the system user can select the modem type or use the default selection. After selection of the modem type, the method queries at step 228 as to whether the configuration setup is to be cancelled. If the response to the query is "YES," then the system user selects "CANCEL" at step 234 and the system returns at step 236 to the Main Menu without saving any changes. If, however, the response to the query at step 228 is "NO," then the system user selects "OK" at step 230 and the system saves the entries at step 232 before returning to the Main Menu at step 236.

Turning to FIG. 3D, path B is shown re-entering at step 240 where a Registration screen is displayed to the system user. Beginning with entry of the Name field at step 242 which includes fields for title, company name and address, the system user makes an entry into each of the registration fields so as to register the initiating node with the system administrator. The user telephone number is entered at step 244 and the method then advances to a query at step 246.

The method queries at step 246 as to whether or not the customer I.D. is known by the system user. If the response to the query is "NO," then the method displays a blank field at step 248 before advancing to step 252. If the response to the query at step 246 is "YES," then the customer I.D. is entered by the system user at step 250; the method then advances to step 252. At step 252, the system user presses the "REGISTER" key to register the initiating node and the method advances to step 254 where the system displays the Billing Information screen. From step 254, the method then advances to a query at step 256.

At step 256, the system queries the system user as to whether or not the displayed billing information is correct. If the response to the query is "YES," then the system user selects "DONE" at step 262 and the method advances to step 264 where the system establishes communication between the initiating node and the system switch. If the response to the query at step 256 is "NO," then the system user enters the correct information in the appropriate field in step 258 and then selects "DONE" at step 260. Step 260 then advances to step 264 where the system establishes communication between the initiating node and the system switch.

Figure 4:
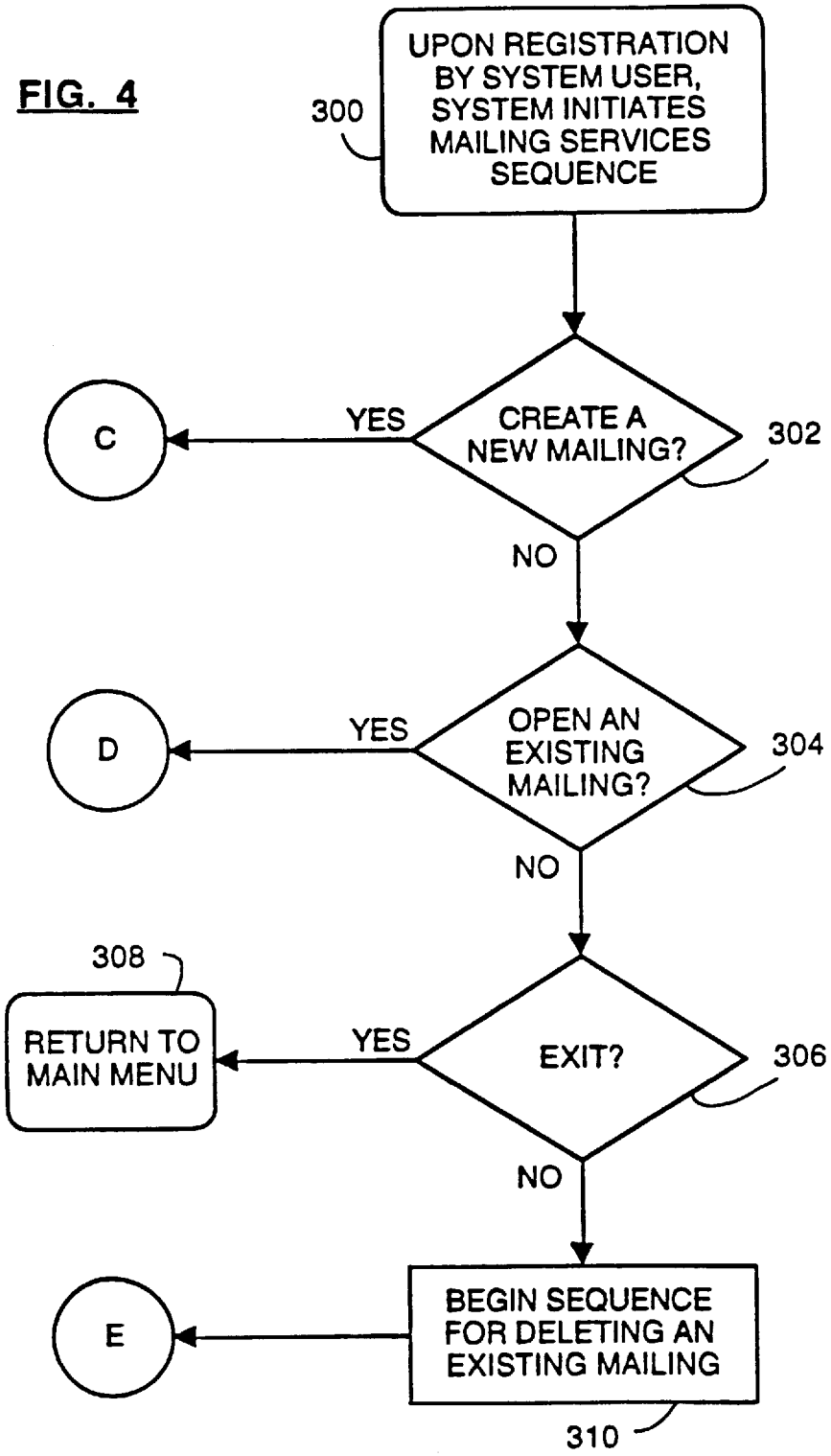
FIG. 4 is a flowchart of the initialization of the selections that can be made by the system user.
Figure 5A:
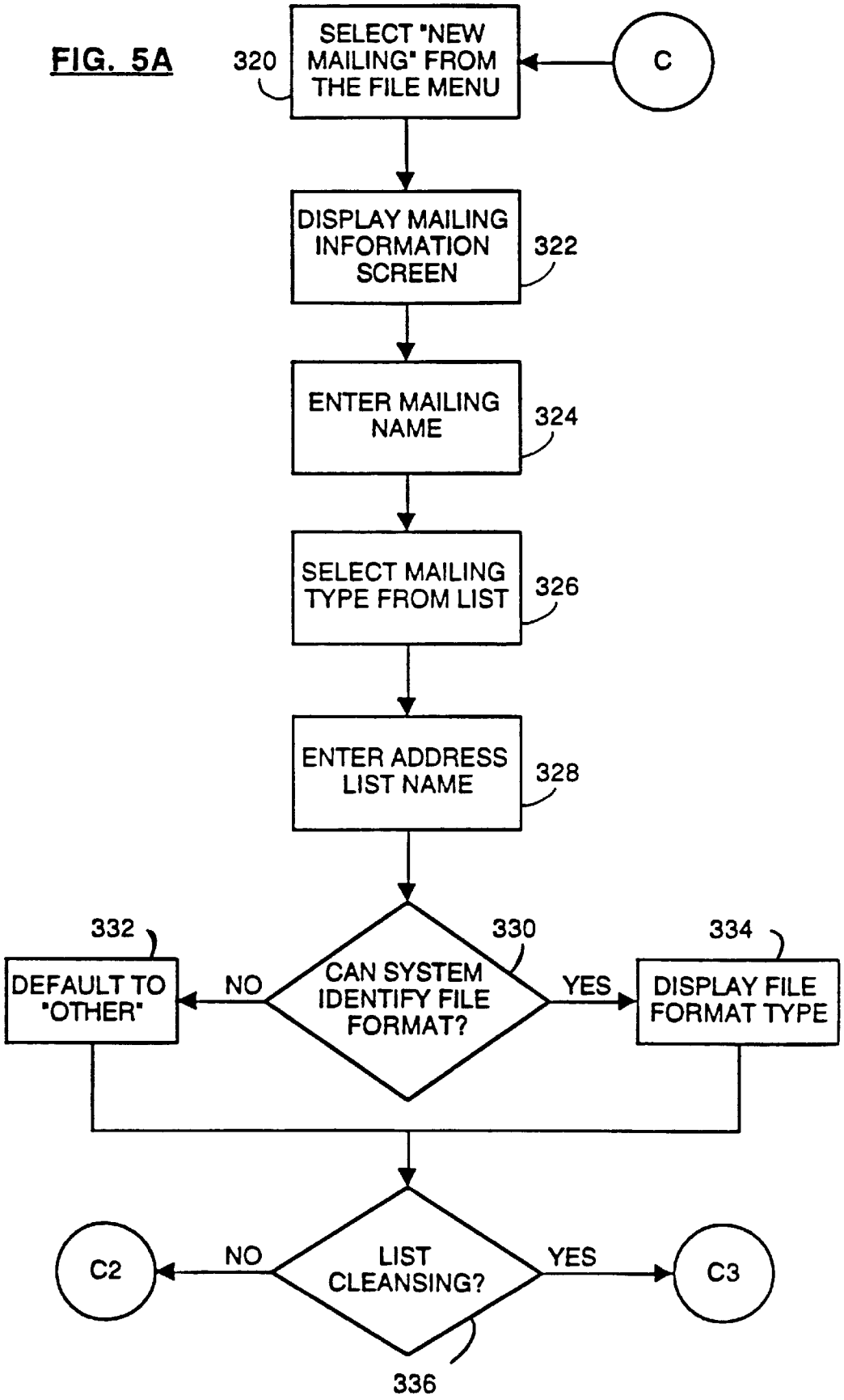
FIGS. 5A through 5Q is a series of flowcharts that details the creation of a new mailing by the system user.

The creation of a mailing project is the keystone of the herein claimed invention. Turning to FIG. 4, there is shown a flowchart of the initialization of the selections that can be made by the system user for setting up or deleting a mailing project. FIG. 4 begins at step 300 where upon registration by the systems user the mailing services sequence is initiated. From step 300, the method advances to a query at step 302, wherein the method queries as to whether or not a new mailing is to be created. If the response to the query is "YES," then the method advances along path C to step 320 as shown in FIG. 5A. If, however, the response to the query at step 302 is "NO," then the system advances to a further query at step 304.

Figure 6:
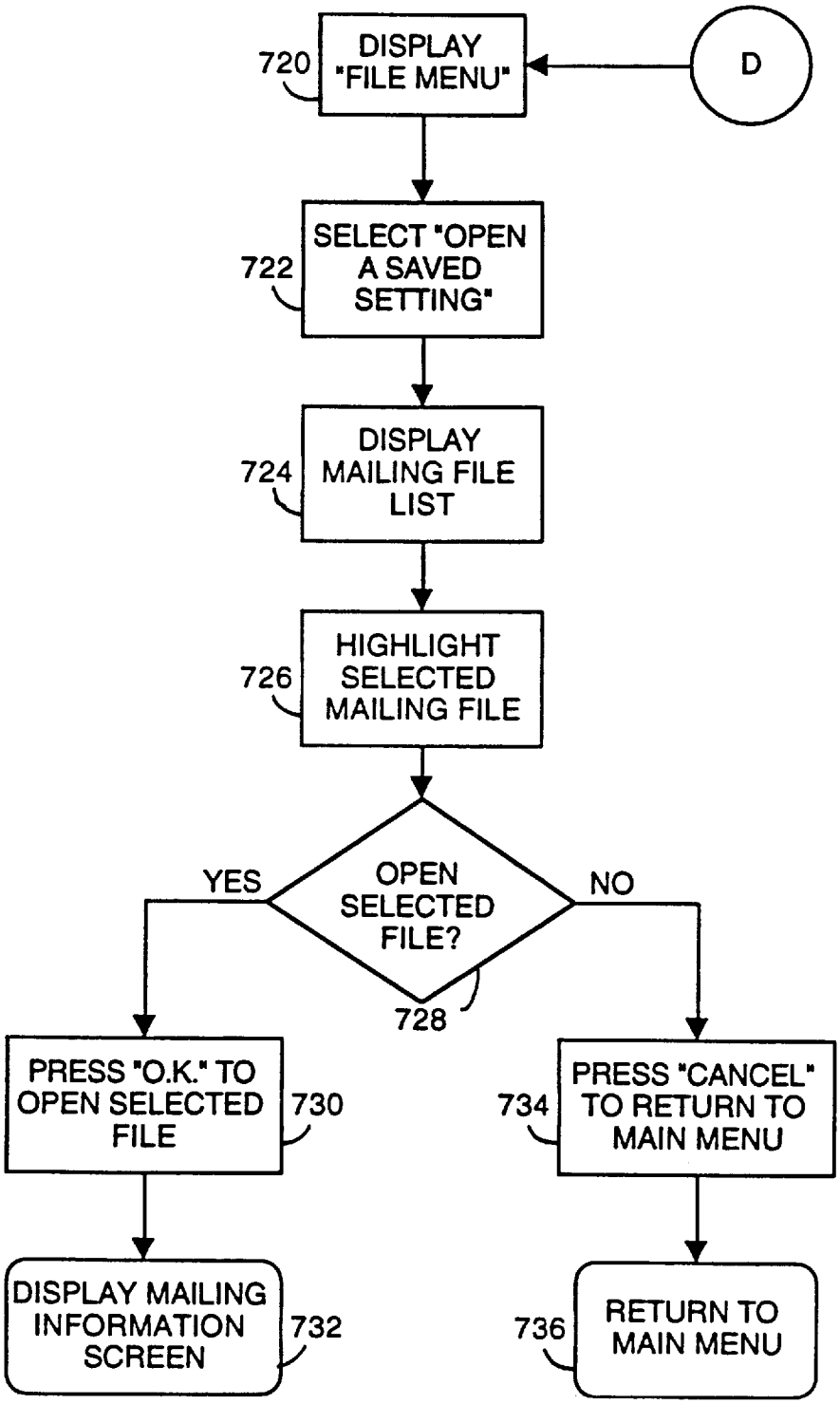
FIG. 6 is a flowchart detailing the opening of an existing mailing within the system.
Figure 7:
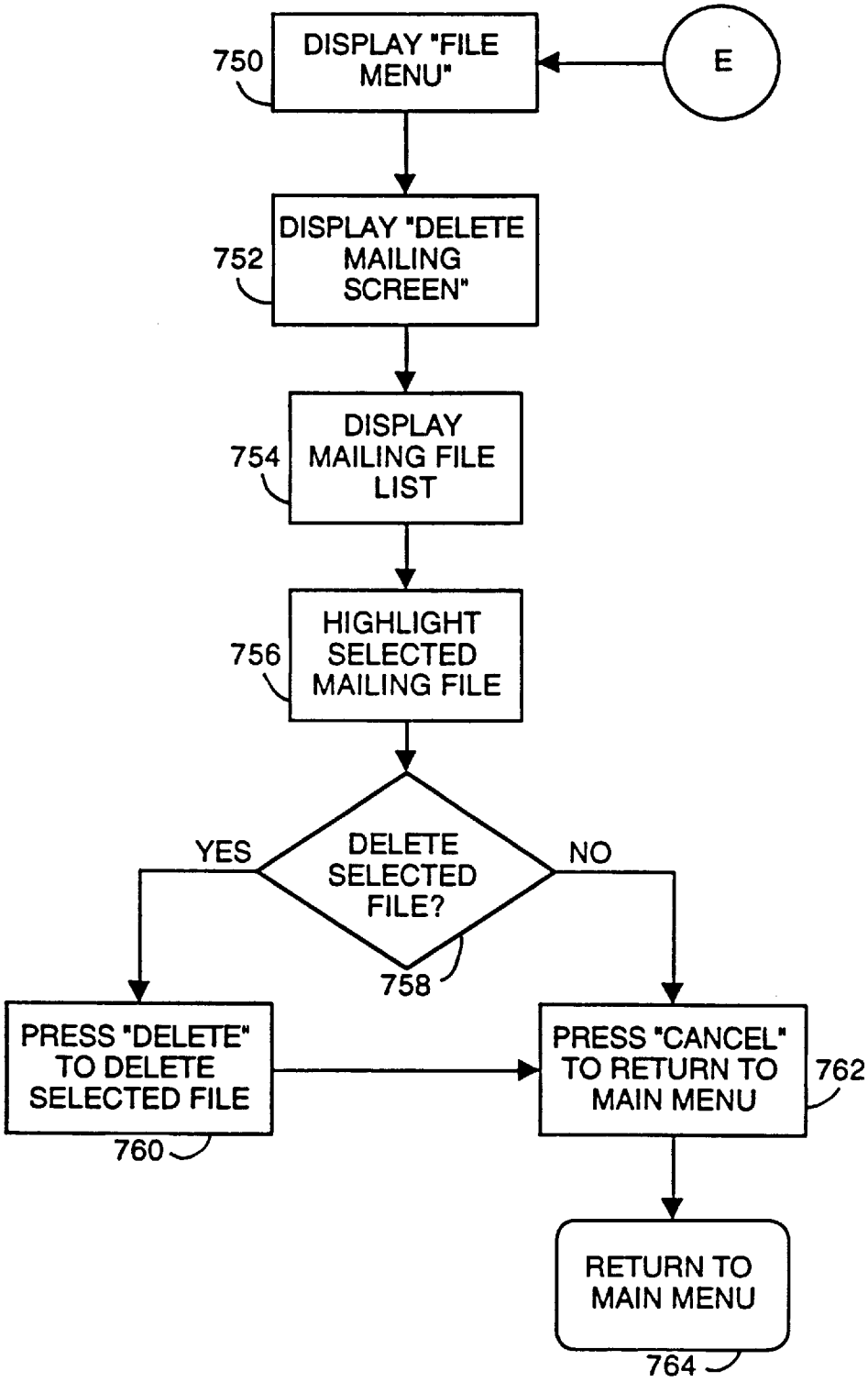
FIG. 7 is a flowchart of the sequence of steps required to delete an existing mailing within the system.

At step 304, the method queries as to whether or not the system user wants to open an existing mailing. If the response to the query is "YES," then the method advances along path D to step 720 as shown in FIG. 6. If, however, the response to the query at step 304 is "NO," then the system advances to a further query at step 306. At step 306, the method queries as to whether or not the system user wishes to exit the system. If the response to the query is "YES," then the method advances to step 308 where the method returns to the Main Menu. If, however, the response to the query at step 306 is "NO," then the system advances to step 310 and begins the sequence for deleting an existing mailing by advancing along path E to step 750 as shown in FIG. 7.

Path C re-enters the method flow at step 320 in FIG. 5A. At step 320, the system user selects "NEW MAILING," whereupon the Mailing Information screen is displayed in step 322. From step 322, the method advances to step 324 by allowing the system user to enter a name for the mailing project. The system will keep a log of all mailing names used. Names of individual mailing projects can be changed by typing over the existing name in the name field. Once a project has been named in step 324, the project type is selected from a list at step 326; the method then advances to step 328. At step 328, the name of the address list is entered and the system will attempt to identify the file format of the list by query at step 330. If the system cannot identify a format, then the system will default to "OTHER" at step 332; however, if the system can make a format identification, then the system will display the file format type at step 334; the system user can change the format by selecting from a list of available options. Both steps 332 and 334 advance directly to a query at step 336.

At step 336, the method queries as to whether or not the system user wants to select "List Cleansing." List Cleansing is a feature that checks for duplicate entries or undeliverable addresses on the selected address list, as well as checking the addresses for formatting by comparing the list address with those available on a database. If the system user selects List Cleansing at step 336, then the method advances along path C3 to re-enter at step 338 as shown in FIG. 5B; otherwise, if the system user chooses not to select List Cleansing, then the method advances along path C2 to re-enter at step 340 as shown in FIG. 5B.

Figure 5B:
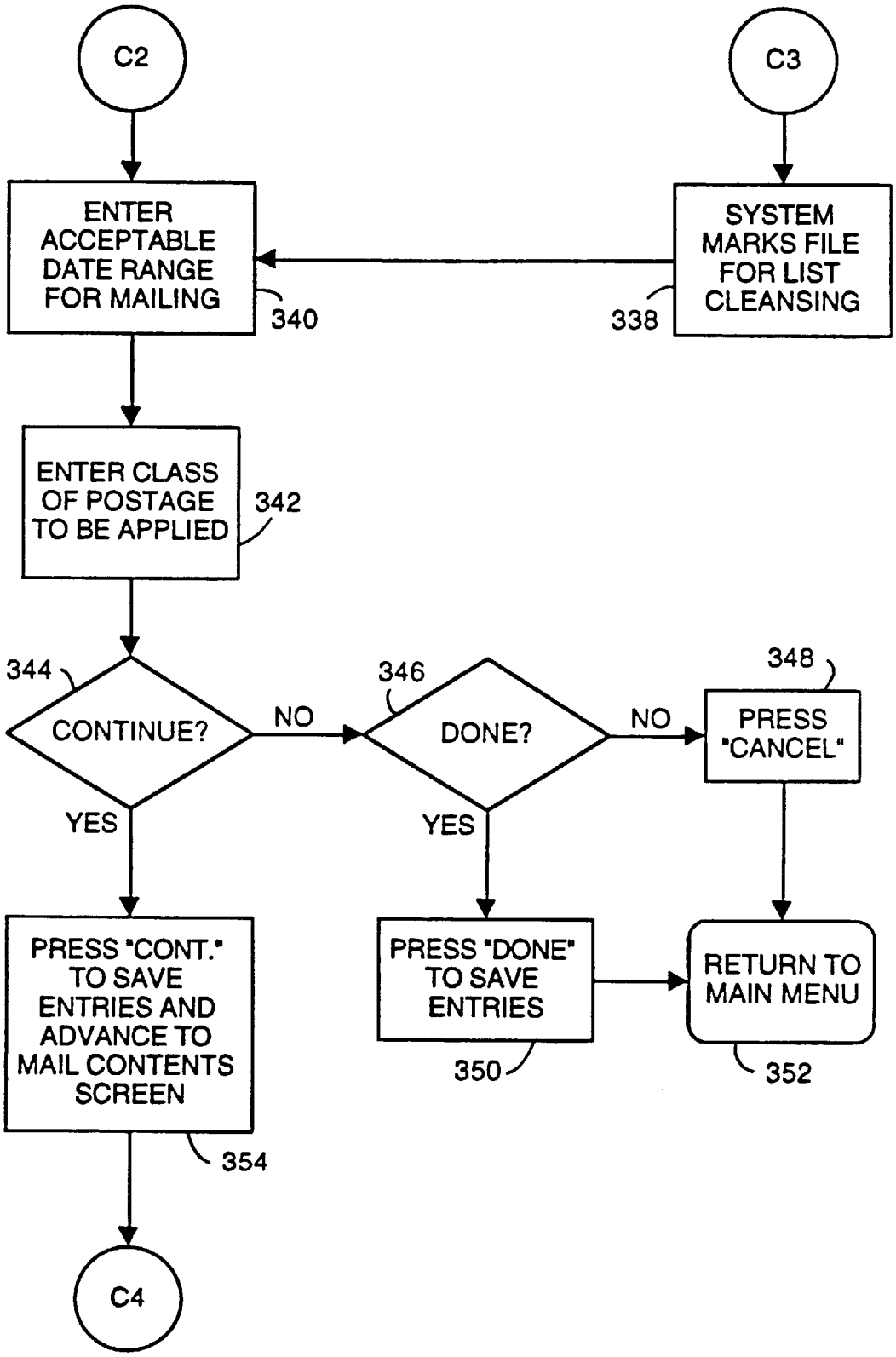

Turning to FIG. 5B, there is shown path C3 re-entering at step 338. At step 338, the system will mark the file for List Cleansing before advancing to step 340 where path C2 re-enters the method flow. List Cleansing will be performed when the mailing is actually downloaded to the production facility for printing and assembly of the mail project. Step 340 establishes the time parameters of the mailing project.

The system user, at step 340, enters the desired range of dates during which the mailing can take place; a default date can be pre-determined so that the default would represent the earliest date for performance. A default for the latest date for a mailing is possible as well. From step 340, the method advances to step 342 where the class of postage to be applied to the mailing is entered. Once the class of postage has been selected, the method advances to a query at step 344.

Once the entries to a particular series of prompts or requests have been made, the system user has several options. If the prompt entries are complete and the system operator is not advancing further in establishing the mailing parameters, then the "DONE" key can be selected which will save the entries made and then the system user will be returned to the Main Menu. If, however, the system user does not want the entries saved, then "CANCEL" is selected and the system user is returned to the Main Menu and no screen entries are saved. A third selection available to the system user is the choice of "CONT.". This choice will save the current entries and advance the system user to the next screen.

It is important to note, that in a preferred embodiment of the invention, series of method steps are represented in the screens displayed to the system user. On any particular screen, a number of prompts or selections may be possible in no particular order (i.e., a Mailing Information screen where several choices are present for several different setup parameters). It is important that the selections be made or that the prompts be responded to; however, it is not important that selections or prompts be responded to in a particular order.

Figure 5C:
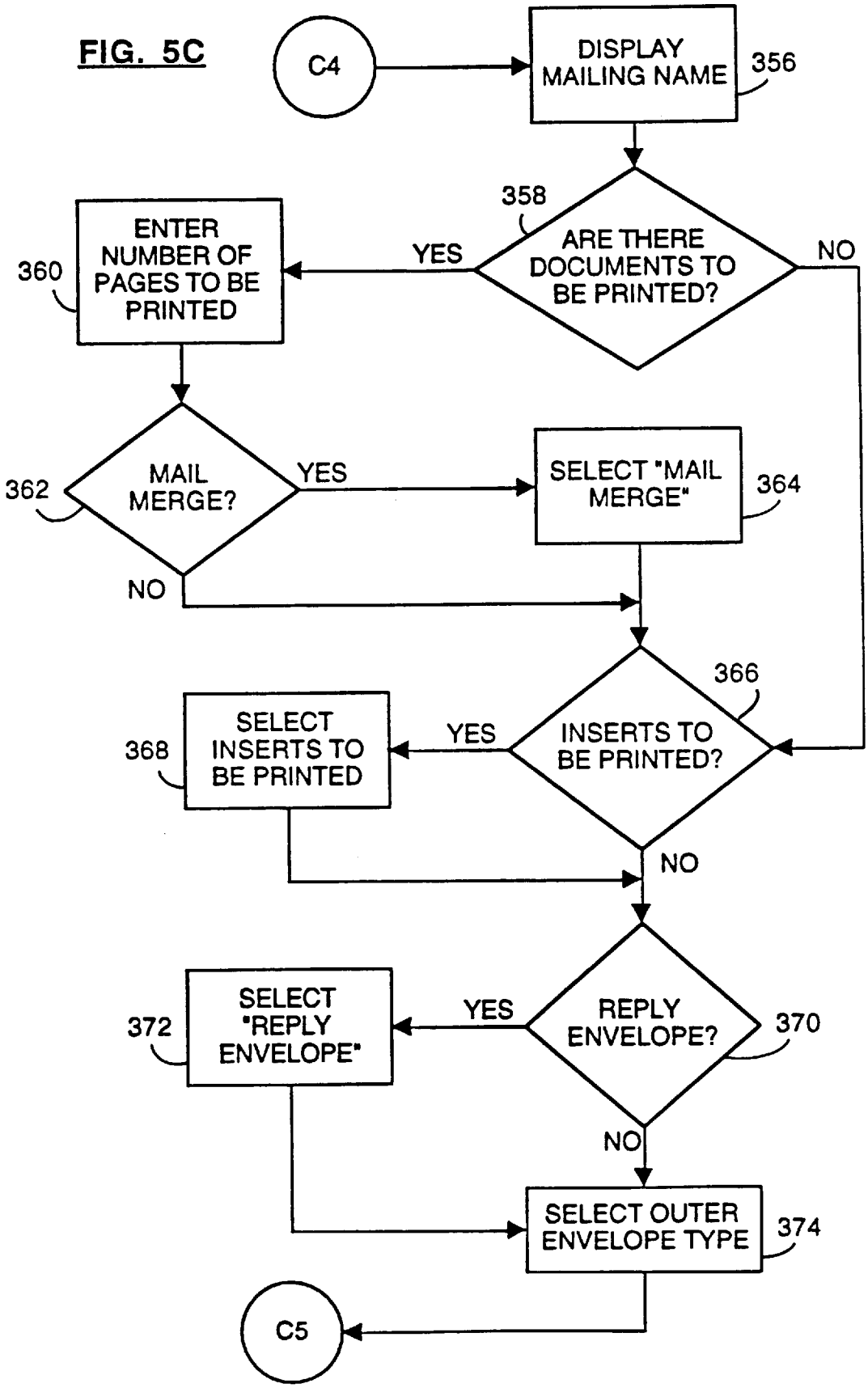

Returning to FIG. 5B, at step 344 the method queries as to whether or not the system user wishes to continue in setting up the parameters of the mailing project. If the response to the query is "YES," then the system advances to step 354 where the system user presses "CONT." to save the current entries and to advance to the Mail Contents screen along path C4 which re-enters at step 356 as shown in FIG. 5C. If, however, the response to the query at step 344 is "NO," then the method advances to a query at step 346 which asks if the system user is done making entries. If the response to the query is "NO," then the method advances to step 348 where the system user presses "CANCEL." If the response to the query at step 346 is "YES," then the method advances to step 350 where the system user presses "DONE" to save the current entries. Both steps 348 and 350 advance to step 352 where the system returns the user to the Main Menu.

Turning to FIG. 5C, there is shown path C4 re-entering the method at step 356. At step 356, the Mailing Contents screen is shown and towards the top of the screen the name of the particular mail job is displayed. The method advances from step 356 to a query at step 358.

Step 358 presents a query as to whether or not there is a document to be printed. If the response to the query is "NO," then the method advances to a query at step 366. If. however, the response to the query at step 358 is "YES," then the method advances to step 360 where the system user enters the number of pages that are to be printed. From step 360, the method advances to a query at step 362. Step 362 queries as to whether or not a Mail Merge is to be employed. Mail Merge is known in the industry and takes selected address information from the address file and merges the information into the selected document. If the response to the query at step 362 is "NO," then the method advances to the query at step 366. If. however, the response to the query at step 362 is "YES," then the method advances to step 364 where the system user selects the Mail Merge feature before advancing to step 366.

At step 366, the system queries as to whether or not there are inserts to be printed. If the response to the query is "NO," then the method advances to a query at step 370. If, however, the response to the query at step 366 is "YES," then the system user selects the inserts to be printed at step 368 before advancing to the query at step 370.

At step 370, the system queries as to whether or not there is a reply envelope to be printed. If the response to the query is "NO," then the method advances to step 374 where the system operator selects the outer envelope type or some alternative mailer form. If, however, the response to the query at step 370 is "YES," then the system user selects the appropriate envelope or mailer type to be printed at step 372 before advancing to step 374. From step 374, the system advances along path C5 to re-enter the method flow at step 376 as shown in FIG. 5D.

Figure 5D:
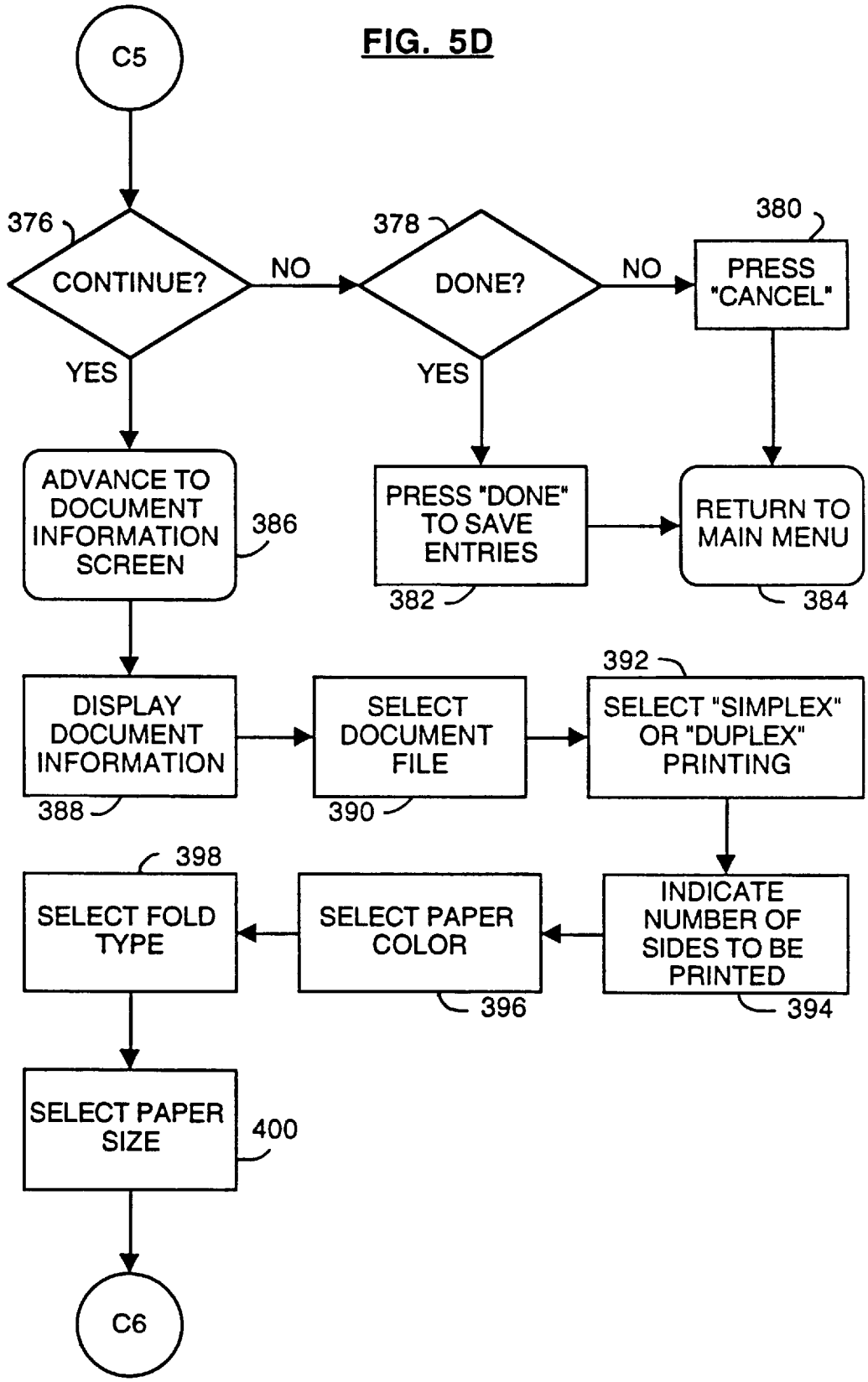

Turning to FIG. 5D, there is shown a series of selections that can be made to further define the parameters of the requested mailing. The method flow begins with a query at step 376; additionally, path C5 coming from FIG. 5C re-enters the flow at step 376. At step 376, the method queries as to whether or not the system operator wants to continue defining the mailing. If the response is "YES," then the method advances to step 386; otherwise, if the response to the query at step 376 is "NO," then the method advances to a query at step 378. At step 378, the method queries as to whether or not the system operator is done defining the mailing. If the response to the query is "NO," then the method advances to step 380 where the system user presses "CANCEL" and any entries made in defining the mailing are not retained within the system memory. If the response to the query at step 378 is "YES," then the method advances to step 382 where the system user presses "DONE" to save the current entries. Both steps 380 and 382, advance to step 384 where the system returns the user to the Main Menu.

Returning to step 386, the system advances to the Document Information Screen. The Document Information Screen displays, at step 388, the physical parameters of the document that can be selected by the system operator. The method then advances to step 390 where a document file is selected from a predetermined list of available files. From step 390, the method advances to step 392 where "Simplex" or "Duplex" printing is selected. Simplex printing causes the document to be printed on one side only, while duplex printing causes the document to be printed on both sides. The method advances from step 392 to step 394, where the system user indicates the total number of sides to be printed before advancing to step 396 where the paper color is selected from a list of available paper colors. In a preferred embodiment of the current invention, the default paper color is white, though this can be changed depending upon the applications or needs of the system users. After selection of the paper color, the system user can select, at step 398, one of the varied ways in which document pages can be folded (i.e., half-fold, C-fold, or Z-fold); the method then advances to step 400 where the paper size is selected before advancing along path C6 to re-enter the method flow at step 402 as shown in FIG. 5E.

Figure 5E:
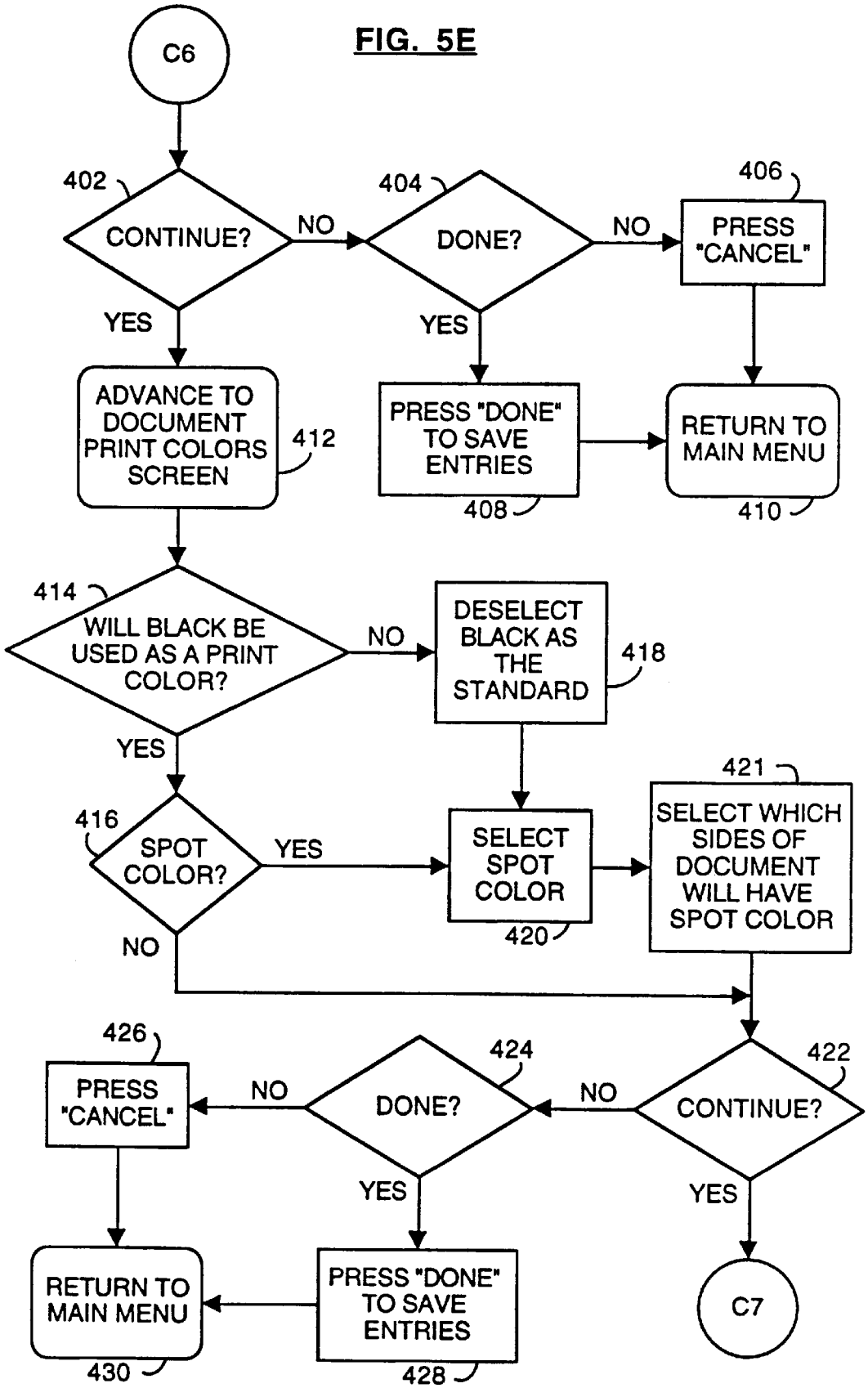

Turning to FIG. 5E, the method flow begins with a query at step 402; additionally, path C6 coming from FIG. 5D re-enters the flow at step 402. At step 402, the method queries as to whether or not the system operator wants to continue defining the mailing. If the response is "YES," then the method advances to step 412; otherwise, if the response to the query at step 402 is "NO," then the method advances to a query at step 404.

At step 404, the method queries as to whether or not the system operator is done defining the mailing. If the response to the query is "NO," then the method advances to step 406 where the system user presses "CANCEL" and any entries made in defining the mailing are not retained within the system memory. If the response to the query at step 404 is "YES," then the method advances to step 408 where the system user presses "DONE" to save the current entries. Both steps 406 and 408, advance to step 410 where the system returns the user to the Main Menu.

Returning to step 412, the system advances to the Document Print Colors screen before the method queries at step 414 as to whether or not black is to be the standard print color. If the response to the query is "NO," then the method de-selects black as the standard at step 418 and allows the system user at step 420 to select another color to be used for printing from the spot color list. If, however, the response to the query at step 414 is "YES," then the method advances to the query at step 416. At step 416, the method queries as to whether or not spot color is to be employed in printing the document. The use of spot color in addition to the primary black allows documents to establish a greater visible impact. The placement of the color is determined within the document data. If the response to the query at step 416 is "NO," then the method advances to a query at step 422; otherwise, the method advances to step 420 where the spot color is selected. From step 420, the system advances to step 421 where the system operator selects which sides of the document are to receive spot color; the method then advances to a query at step 422.

Figure 5F:
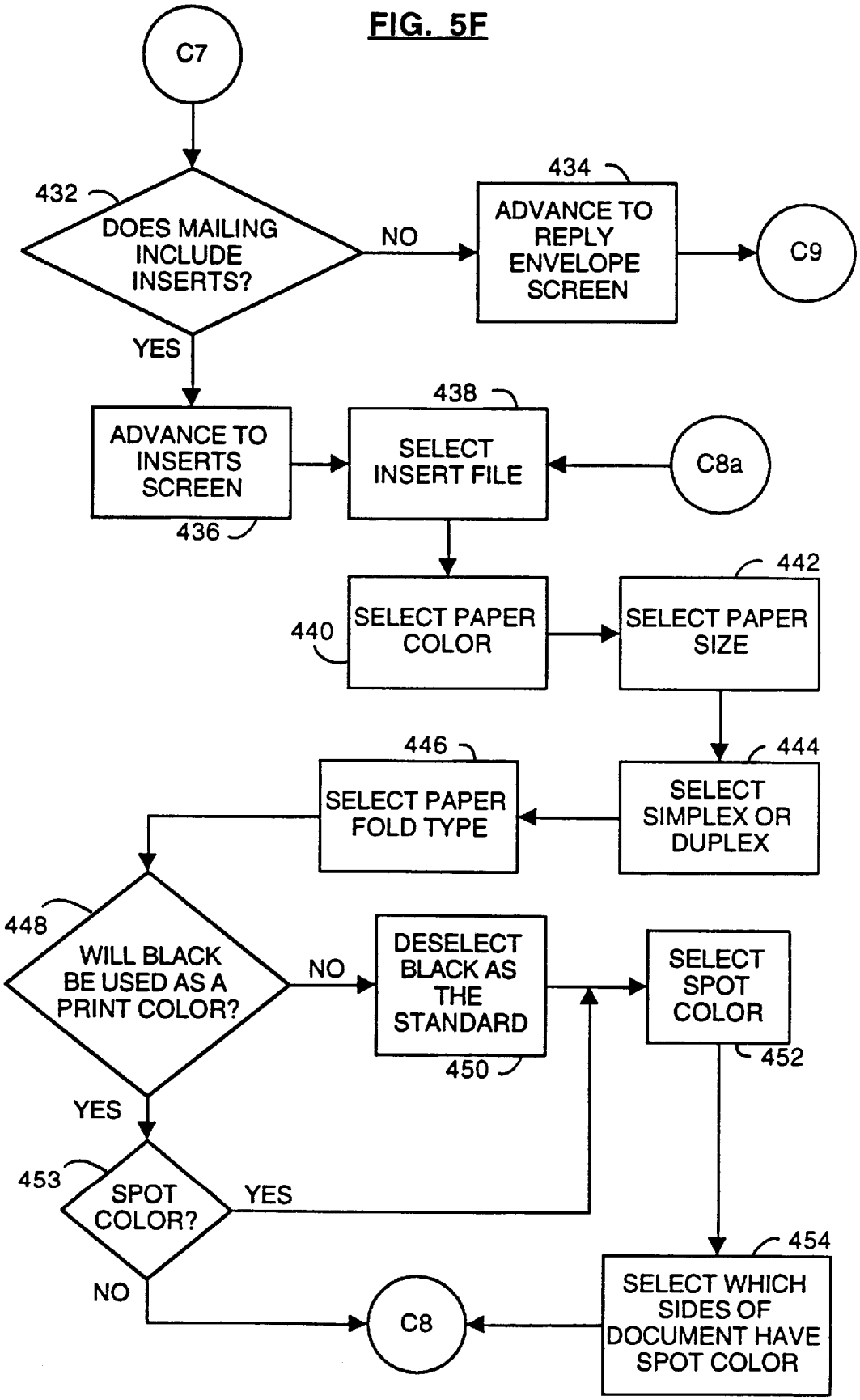

At step 422, the method queries as to whether or not the system operator wishes to continue with the setup process. If the response is "YES," then the method advances along path C7 to re-enter the method flow at step 432 as shown in FIG. 5F. If the response to the query at step 422 is "NO," however, then the method advances to the query at step 424. At step 424, the method queries as to whether or not the system operator is done defining the mailing. If the response to the query is "NO," then the method advances to step 426 where the system user presses "CANCEL" and any entries made in defining the mailing are not retained within the system memory. If the response to the query at step 424 is "YES," then the method advances to step 428 where the system user presses "DONE" to save the current entries. Both steps 426 and 428, advance to step 430 where the system returns the user to the Main Menu.

Figure 5G:
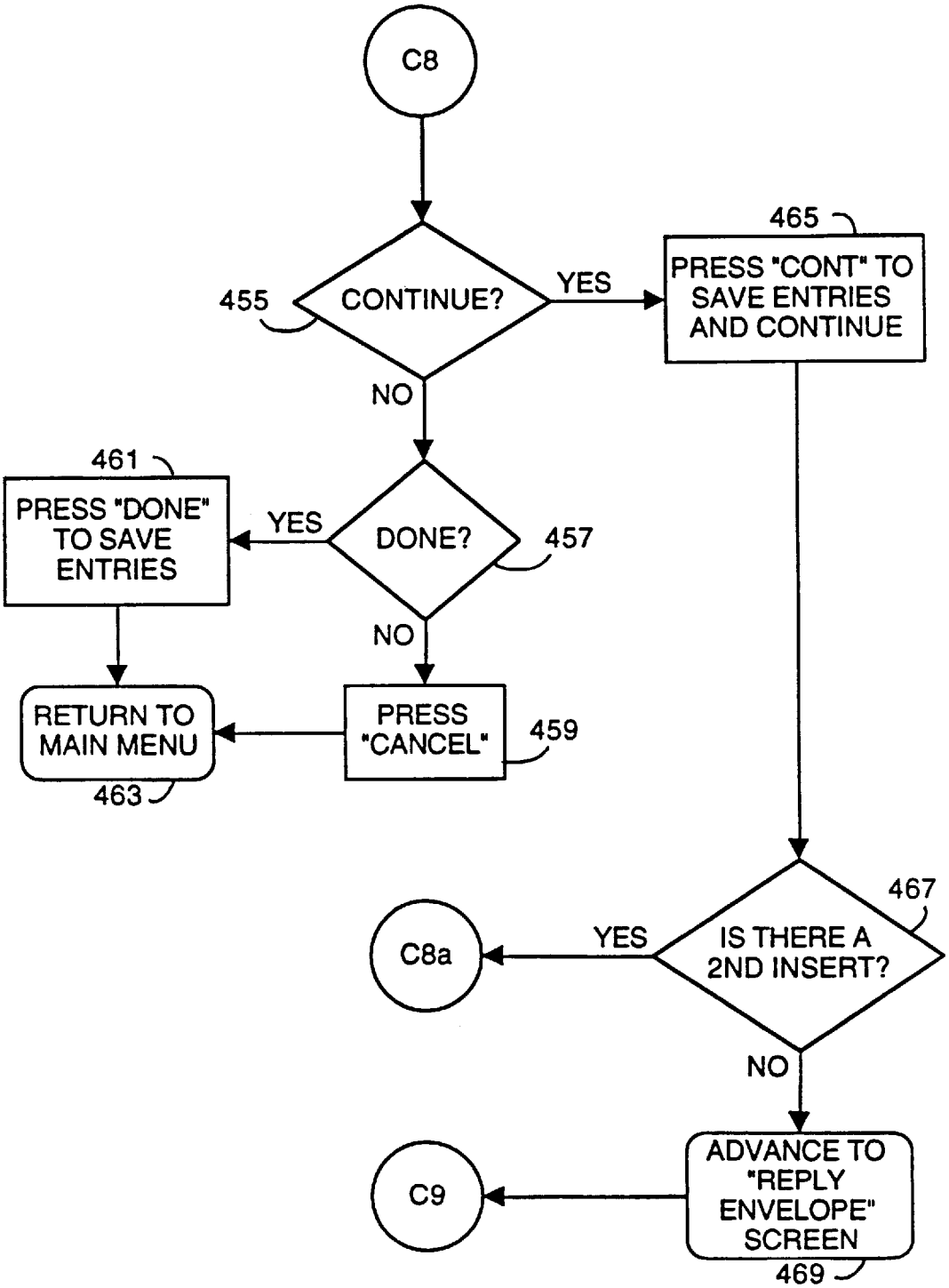
Figure 5H:
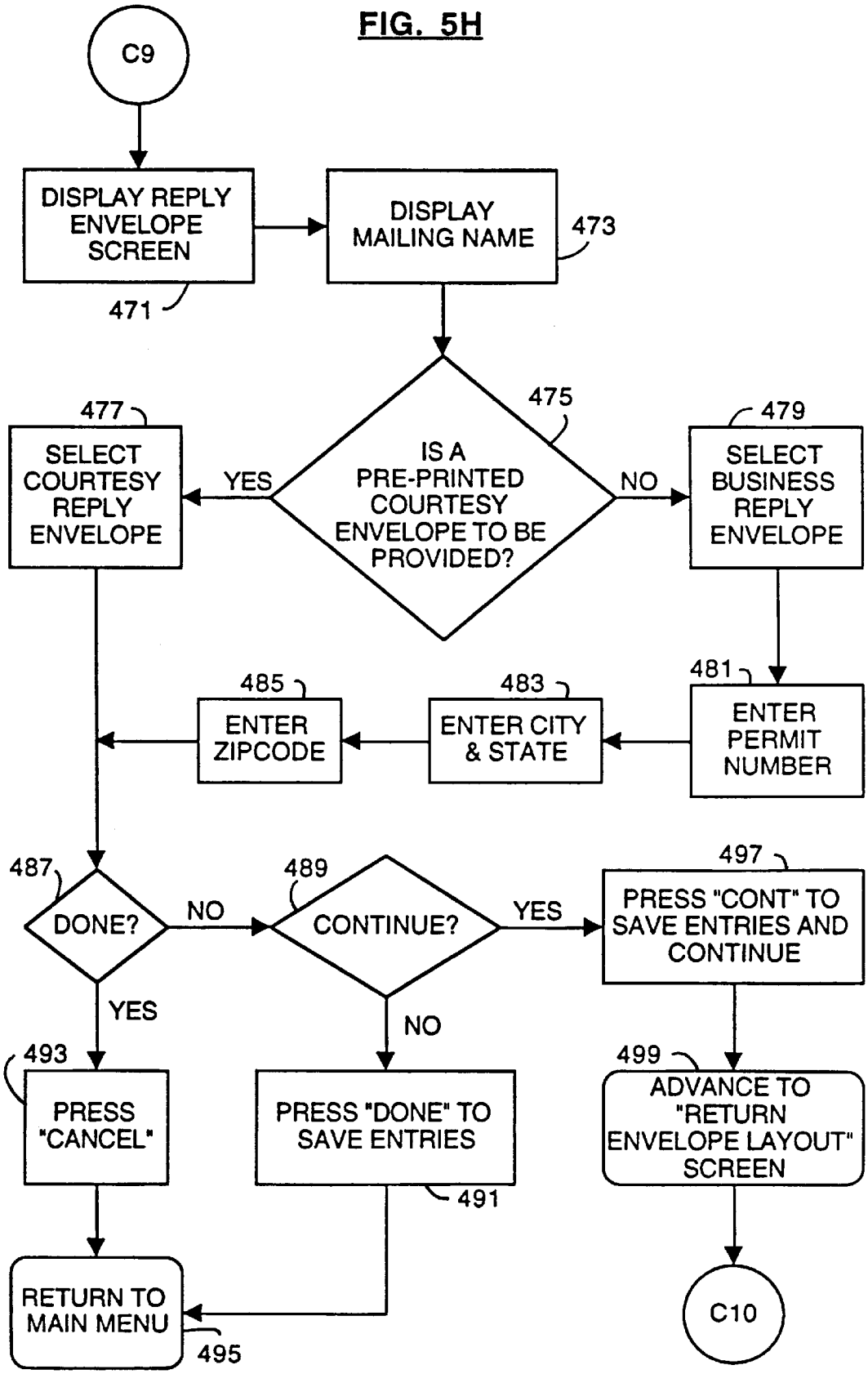

Path C7 re-enters the method flow at step 432 as shown in FIG. 5F. Step 432 is a query which asks if the mailing that is being defined includes an insert. If the system operator did not indicate at step 366 that an insert was to be a part of the defined mailing, then the system would answer the query at step 432 with "NO," and advance at step 434 to the Reply Envelope screen. From step 434, the method advances along path C9 to re-enter the method flow at step 471 as shown in FIG. 5H. If, however, the reply to the query at step 432 were "YES," then the method advances at step 436 to the Inserts screen.

The Inserts screen allows the system operator to define the parameters of the insert to be placed within the mailing. From step 436, the method advances to step 438 where an insert file is selected from a list of available files. Additionally, path C8a emanating from step 467 as shown in FIG. 5G re-enters the flow at step 438. Once the insert file is selected, the system operator selects paper color at step 440, paper size at step 442, and then at step 444 as to whether or not the print scheme is to be simplex or duplex (front only, or front and back) relative to the paper. From step 444, the system advances to step 446 where the paper fold type is selected. Fold types include, but are not limited to: half-folds; C-fold; Z-fold; or perforated.

After the paper fold type has been selected at step 446, the method advances to a query at step 448. At step 448, the system queries as to whether or not black is to be the standard print color. If the response to the query is "NO," then the method de-selects black as the standard at step 450 and allows the system user at step 452 to select another color to be used for printing from the spot color list. If, however, the response to the query at step 448 is "YES," then the method advances to the query at step 453. At step 453, the method queries as to whether or not spot color is to be employed in printing the document. The placement of the color is determined within the document data. If the response to the query at step 453 is "NO," then the method advances along path C8 to re-enter the flow at step 455 as shown in FIG. 5G; otherwise, the method advances to step 452 where the spot color is selected. From step 452, the system advances to step 454 where the system operator selects which sides of the document are to receive spot color; the method then advances along path C8 to re-enter the flow at step 455 as shown in FIG. 5G.

Turning to FIG. 5G, there is shown path C8 re-entering the flow at step 455. At step 455, the method queries as to whether or not the system operator wishes to continue with the setup process. If the response is "YES," then the method advances to step 465 where the system operator presses "CONT" to save the entries made and to continue. Step 465 advances to the query at step 467 where the system operator asks if there is a second insert. If the response to the query at step 467 is "YES," then the method returns along path C8a to step 438 as shown in FIG. 5F. If, however, the response to the query at step 467 is "NO," then the method advances to step 469 where the system advances to the Reply Envelope Screen and then advances along path C9 to step 471 as shown in FIG. 5H.

Returning to step 455, if the response to the query at step 455 is "NO," then the method advances to the query at step 457. At step 457, the method queries as to whether or not the system operator is done defining the mailing. If the response to the query is "NO," then the method advances to step 459 where the system user presses "CANCEL" and any entries made in defining the mailing are not retained within the system memory. If the response to the query at step 457 is "YES," then the method advances to step 461 where the system user presses "DONE" to save the current entries. Both steps 459 and 461, advance to step 463 where the system returns the user to the Main Menu.

Turning to FIG. 5H, there is shown path C9 re-entering the flow at step 471. The Reply Envelope screen is displayed at step 471 and at the top of the screen the name of the mail job is displayed in step 473. From step 473, the method advances to the query at step 475. At step 475, the method queries as to whether or not a pre-printed courtesy envelope is to be provided. If the response to the query is "YES," then the system operator selects the courtesy reply envelope choice at step 477 before advancing to the query at step 487. If the response to the query at step 475 is "NO," then the system operator selects a business reply envelope (BRE) at step 479, enters the BRE permit number at step 481, enters at step 483 the city and state to be printed upon the BRE, then enters the zip code at step 485. Steps 477 and 485 both advance to the query at step 487.

At step 487, the method queries as to whether or not the system operator is done defining the mailing. If the response to the query is "YES," then the method advances to step 493 where the system user presses "CANCEL" and any entries made in defining the mailing are not retained within the system memory. If the response to the query at step 487 is "NO," then the method advances to the query at step 489. At step 489, the method queries as to whether or not the system operator wants to continue with the setup process. If the response is "YES," then the method advances to step 497 where the system operator presses "CONT" to save the entries made and advance to the Return Envelope Layout screen at step 499 before advancing along path C10 to step 501 as shown in FIG. 5I.

Returning to step 489, if the response to the query at step 489 is "NO," then the method advances to step 491 where the system user presses "DONE" to save the current entries. Both steps 491 and 493, advance to step 495 where the system returns the user to the Main Menu.

Figure 5I:
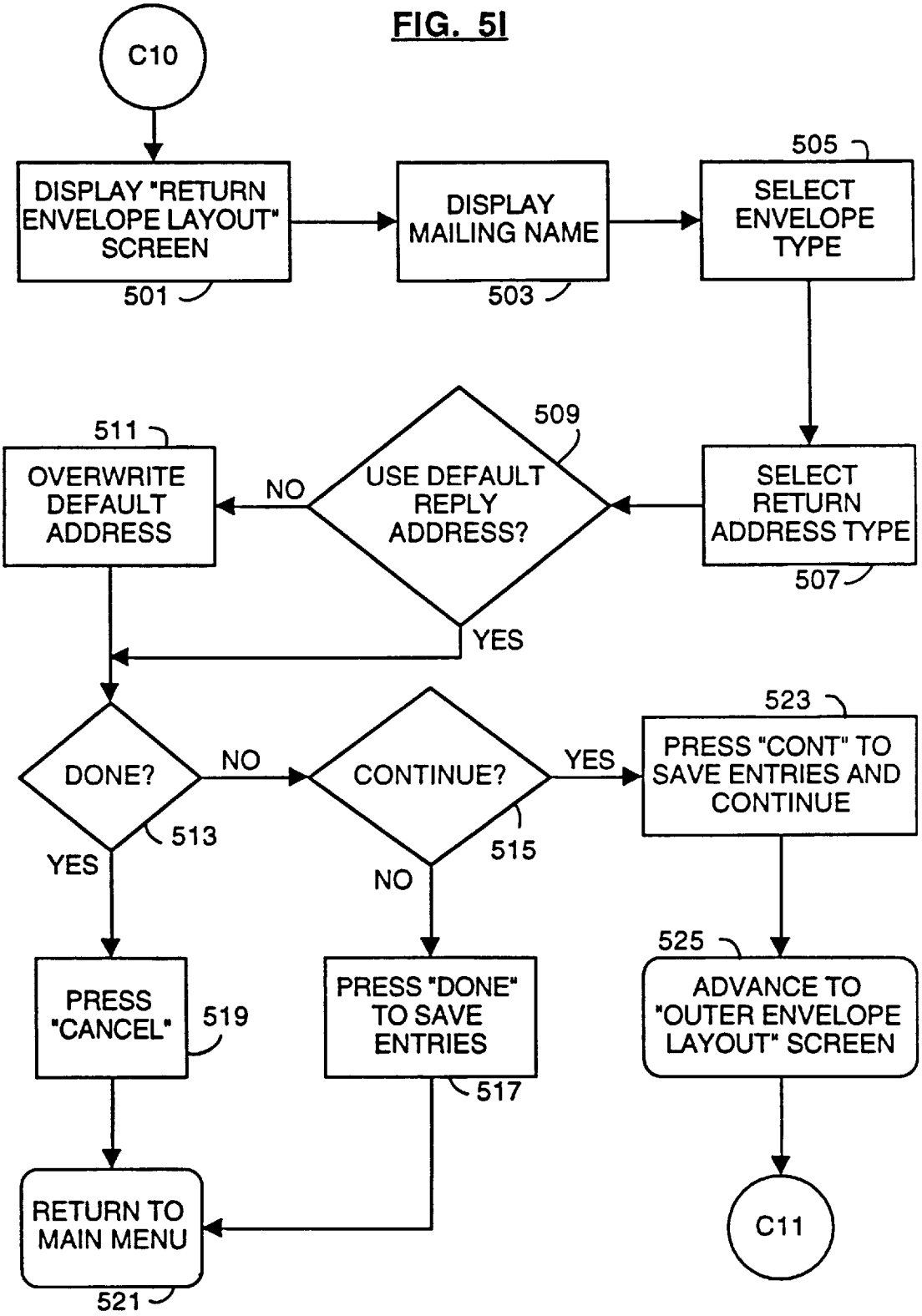

Path C1O re-enters the flow at step 501 as shown in FIG. 5I. The Return Envelope Layout screen is displayed at step 501 and the name of the mailing job is displayed at the top of the screen at step 503. The method advances to step 505 where the system user selects the envelope type from a list of colors and/or size types and then determines at step 507 as to whether or not blank lines or an address will be utilized in the return address section at the upper left hand corner of the envelope or whether no return address will be printed. From step 507, the method advances to the query at step 509. At step 509, the method queries as to whether or not a default reply address is to be used. If the response to the query is "YES," then the method advances to a query at step 513; otherwise, if the response to the query at step 509 is "NO," then at step 511 the system will allow the system operator to overwrite the default address with a new address. It is important to note that the Return Envelope Layout screen shows a graphical view of how the reply envelope is laid out.

Step 509 with a "YES" response and step 511 advance to the query at step 513. At step 513, the method queries as to whether or not the system operator is done defining the mailing. If the response to the query is "YES," then the method advances to step 519 where the system user presses "CANCEL" and any entries made in defining the mailing are not retained within the system memory. If the response to the query at step 513 is "NO," then the method advances to the query at step 515. At step 515, the method queries as to whether or not the system operator wishes to continue with the setup process. If the response is "YES," then the method advances to step 523 where the system operator presses "CONT" to save the entries made and advance to the Outer Envelope Layout screen at step 525 before advancing along path C11 to step 527 as shown in FIG. 5J.

Returning to step 515, if the response to the query at step 515 is "NO," then the method advances to step 517 where the system user presses "DONE" to save the current entries. Both steps 517 and 519, advance to step 521 where the system returns the user to the Main Menu.

Figure 5J:
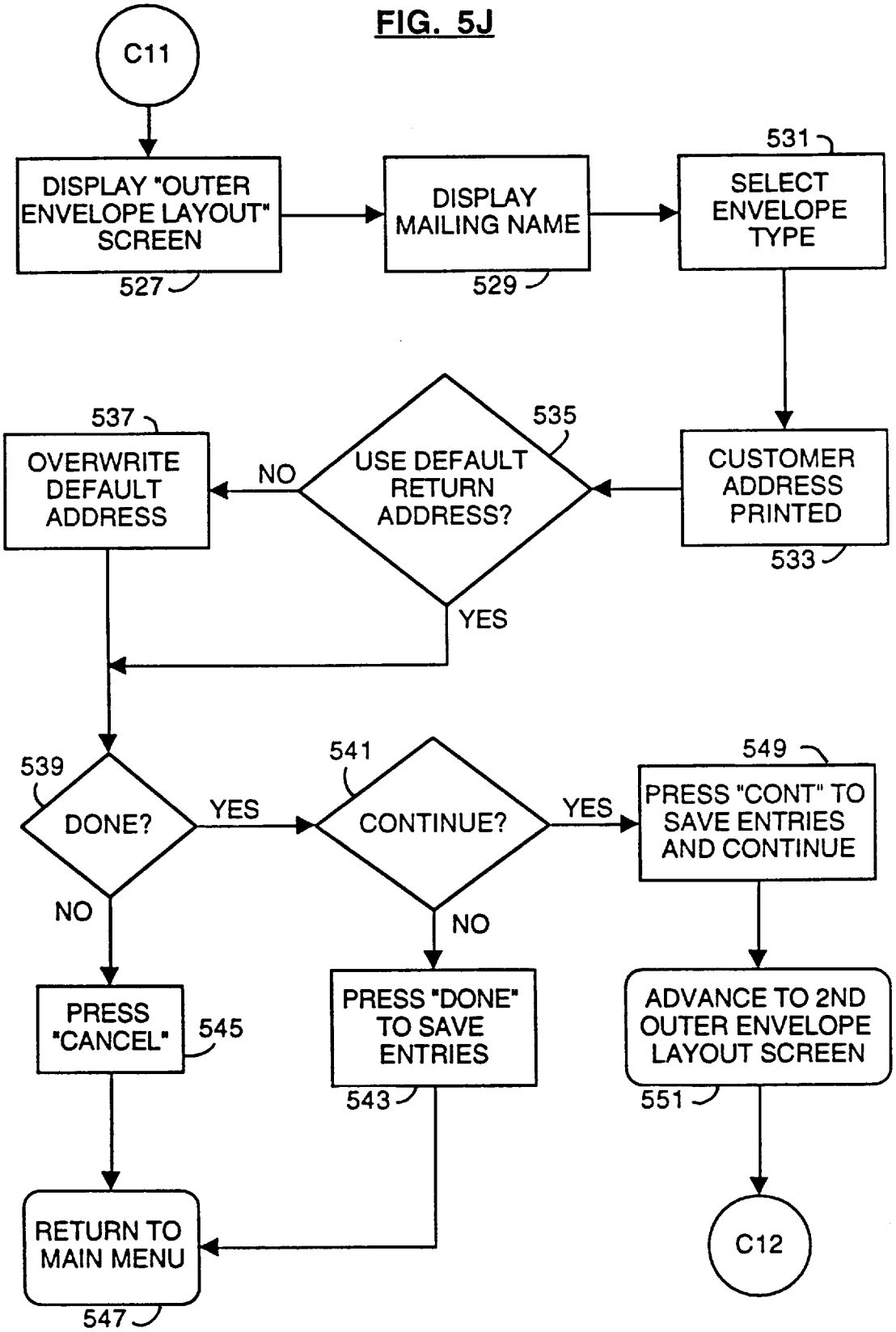

Turning to FIG. 5J, there is shown path C11 re-entering the method flow at step 527. The Outer Envelope—Message Block Layout screen is displayed at step 527 and the name of the mailing job is displayed at the top of the screen at step 529. The method advances to step 531 where the system user selects the envelope type from a list of colors and/or size types and then determines at step 533 as to whether or not blank lines or an address will be utilized in the return address section at the upper left hand carrier of the envelope or whether no return address will be printed. From step 533, the method advances to the query at step 535. At step 535, the method queries as to whether or not a default reply address is to be used. If the response to the query is "YES," then the method advances to a query at step 539; otherwise, if the response to the query at step 535 is "NO," then at step 537 the system will allow the system operator to overwrite the default address with a new address. It is important to note that the Outer Envelope Layout screen shows a graphical view of how the reply envelope is laid out. The customer address is shown in a hatched graphic and will be printed per postal guidelines and as entered in into the system during setup.

Step 535 with a "YES" response and step 537 advance to the query at step 539. At step 539, the method queries as to whether or not the system operator is done defining the mailing. If the response to the query is "NO," then the method advances to step 545 where the system user presses "CANCEL" and any entries made in defining the mailing are not retained within the system memory. If the response to the query at step 539 is "YES," then the method advances to the query at step 541. At step 541, the method queries as to whether or not the system operator wishes to continue with the setup process. If the response is "YES," then the method advances to step 549 where the system operator presses "CONT" to save the entries made and advance to the Second Outer Envelope Layout screen at step 551 before advancing along path C12 to step 553 as shown in FIG. 5K.

Returning to step 541, if the response to the query at step 541 is "NO," then the method advances to step 543 where the system user presses "DONE" to save the current entries. Both steps 543 and 545, advance to step 547 where the system returns the user to the Main Menu.

Figure 5K:
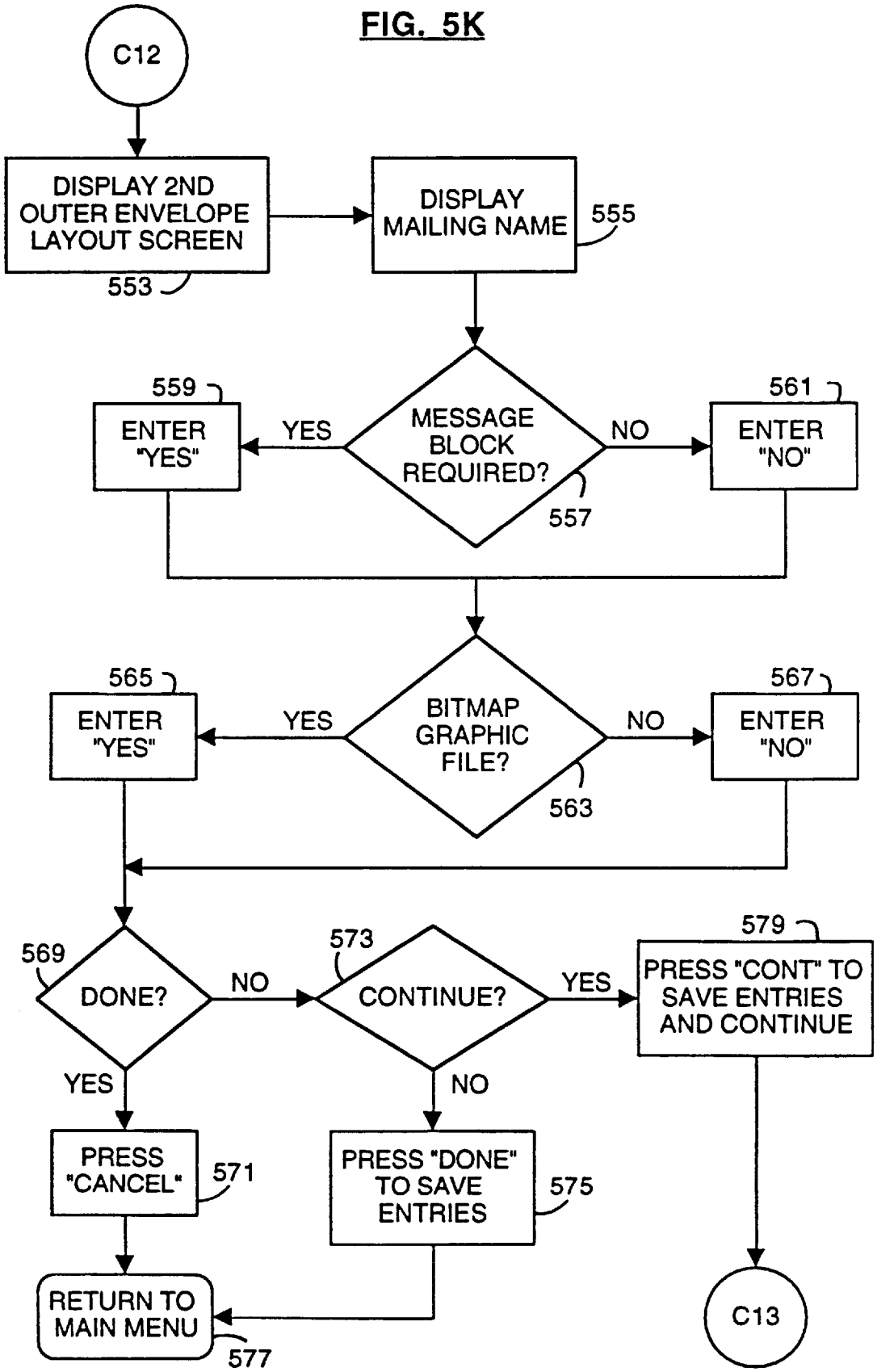

Turning to FIG. 5K, there is shown path C12 re-entering the method flow at step 553. At step 553, the Second Outer Envelope Layout screen is displayed and the name of the mailing job is displayed at the top of the screen at step 555. From step 555, the method advances to a query at step 557 which asks if the Message Block is required. If the response to the query is "YES," then the system operator selects "YES" at step 559 if a message is to be printed on the outside of the envelope; otherwise, "NO" would be selected at step 561. Steps 559 and 561 both advance to a query at step 563 which asks if the bitmap Graphics File is required. If there is a bitmap graphics file to be printed on the envelope then the response to the query is "YES," and then the system operator selects "YES" at step 565; otherwise, "NO" would be selected at step 567. Steps 565 and 567 both advance to a query at step 569.

At step 569, the method queries as to whether or not the system operator is done defining the mailing. If the response to the query is "YES," then the method advances to step 571 where the system user presses "CANCEL" and any entries made in defining the mailing are not retained within the system memory. If the response to the query at step 569 is "NO," then the method advances to the query at step 573. At step 573, the method queries as to whether or not the system operator wishes to continue with the setup process. If the response is "YES," then the method advances to step 579 where the system operator presses "CONT" to save the entries made and advance along path C13 to step 581 as shown in FIG. 5L.

Returning to step 573, if the response to the query at step 573 is "NO," then the method advances to step 575 where the system user presses "DONE" to save the current entries.

Both steps 571 and 575, advance to step 577 where the system returns the user to the Main Menu.

Figure 5L:
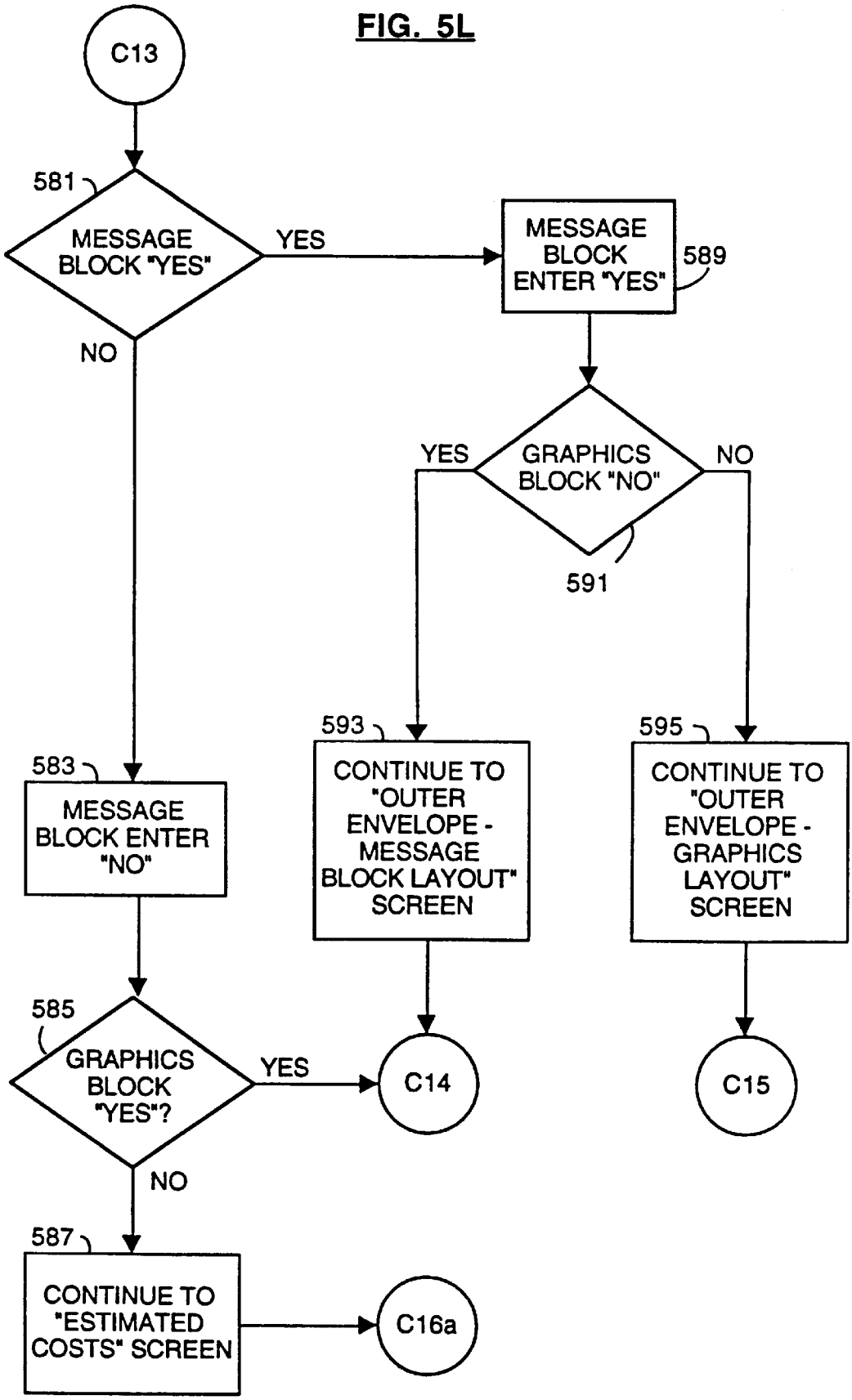

Turning to FIG. 5L, there is shown path C13 re-entering the method flow at step 581. Step 581 is a query which asks if the Message Block is to be utilized. If the response to the query is "NO," then the method advances to step 583 where "NO" is entered in the Message Block request field and the method advances to the query at step 585. At step 585, the system queries as to whether or not the Graphics Block is to be utilized. If the response to the query at step 585 is "NO," then the method advances to step 587 where the system proceeds to the Estimated Costs Screen by advancing along path C16a to step 637 as shown in FIG. 5O. If, however, the response to the query at step 585 is "YES," then the method advances along path C14 to step 597 as shown in FIG. 5M.

Returning to step 581, if the response to the query at step 581 is "YES," then the method advances to step 589 where "YES" is entered in the Method Block request field and the method then advances to the query at step 591. At step 591, the system queries as to whether or not "NO" is to be entered into the Graphics Block request field. If the response to the query at step 591 is "YES," then the method advances to step 593 where the system will continue to the Outer Envelope—Message Block Layout screen by continuing along path C14 to step 597 as shown in FIG. 5M. However, if the response to the query at step 591 is "NO," then the method advances to step 595 where the system will continue to the Outer Envelope—Graphics Layout screen by continuing along path C15 to step 617 as shown in FIG. 5N.

Figure 5M:
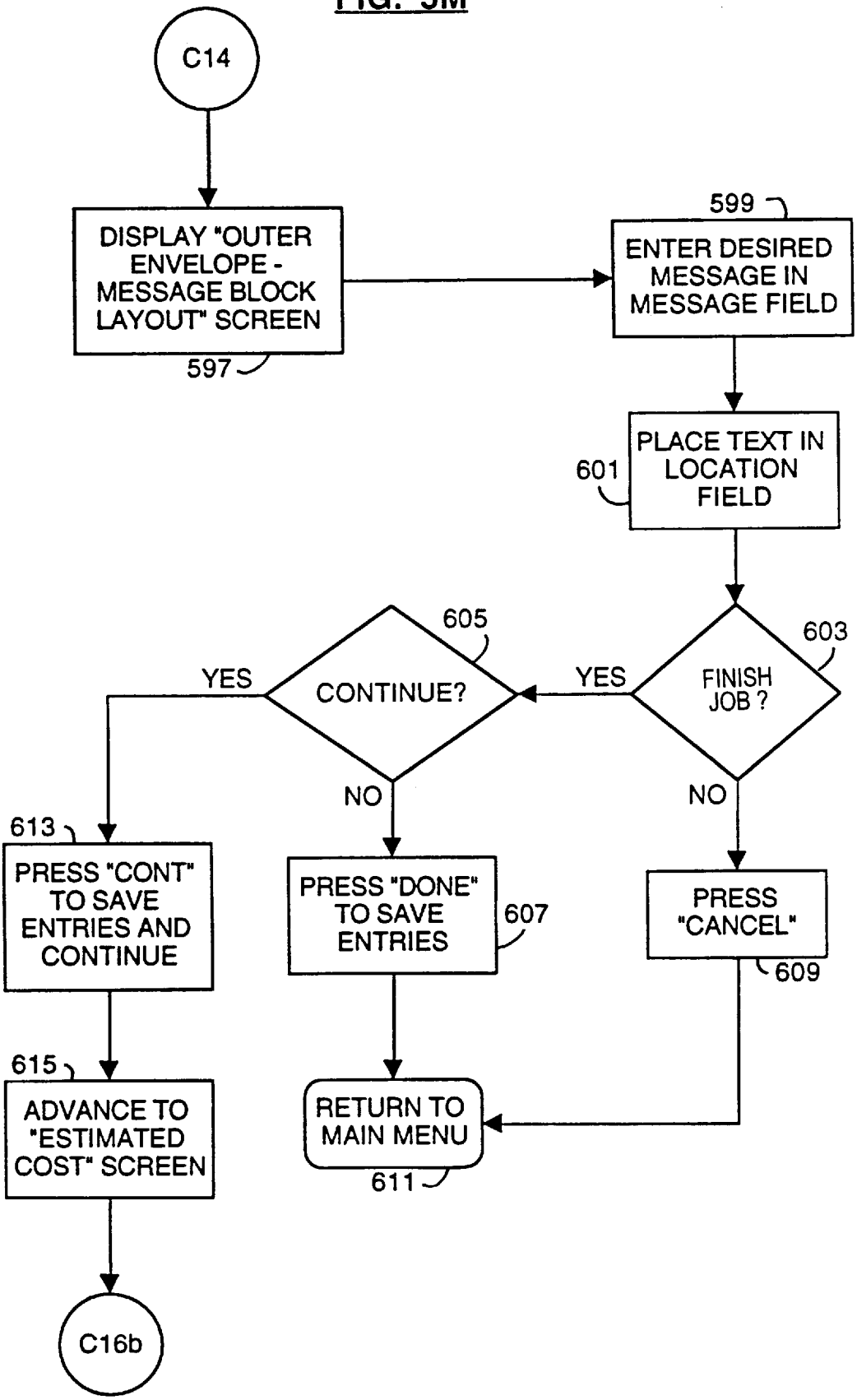
Figure 5N:
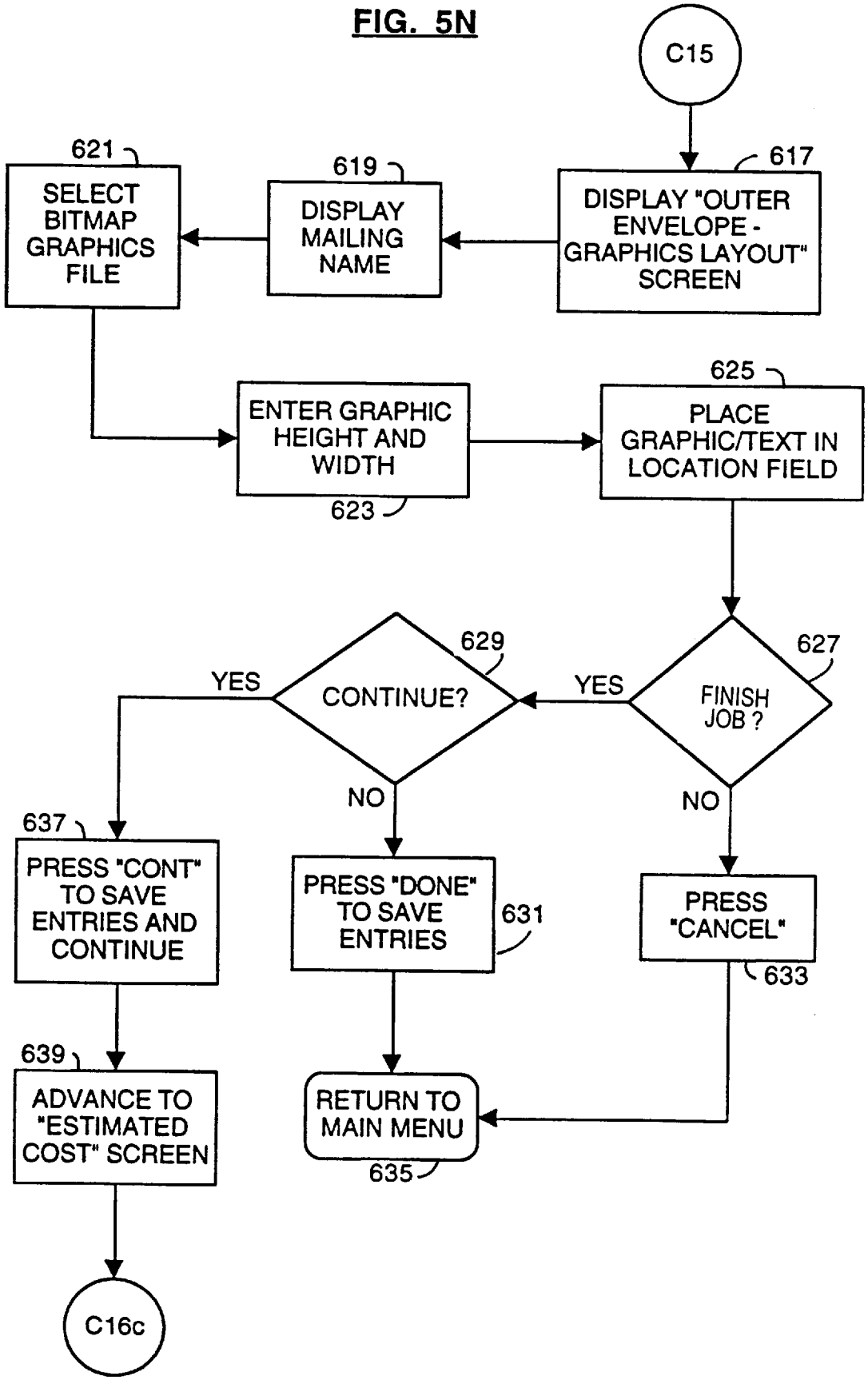
Figure 5O:
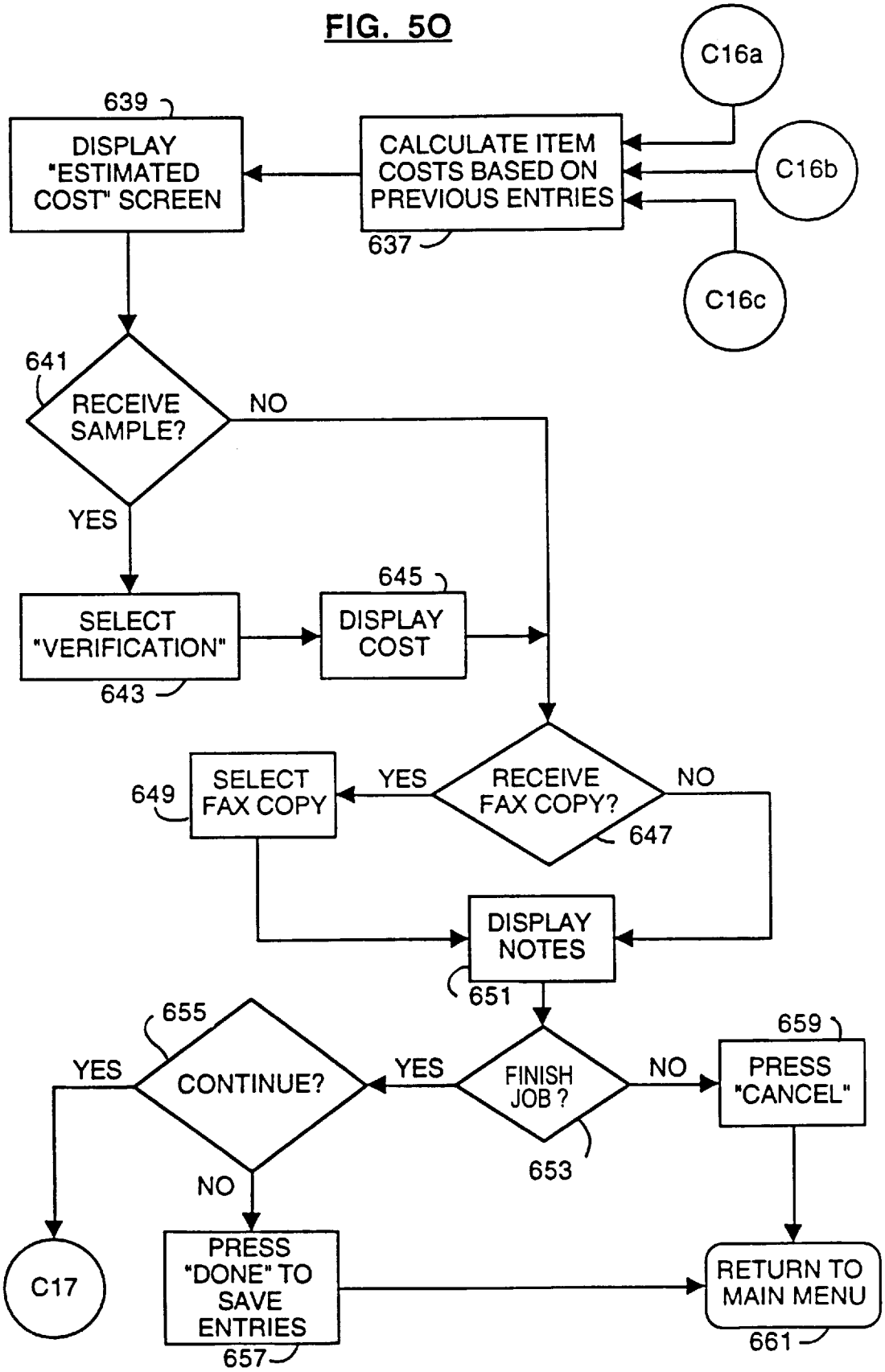

Turning to FIG. 5M, there is shown path C14 re-entering the method flow at step 597. At step 597, the system displays the Outer Envelope—Message Block Layout screen which includes a graphical layout of the envelope as well as the Mailing Name and Message Block for message text entry. From step 597, the method advances to step 599 where the system operator enters the desired message into the Message Block field. Once the desired message has been entered, in step 601 the message text is placed in its proper location by having the system operator utilize the system's keyboard 16 or, in the alternative a "mouse," to select the desired location within the envelope field.

At step 603, the method queries as to whether or not the system operator is done defining the mailing. If the response to the query is "NO," then the method advances to step 609 where the system user presses "CANCEL" and any entries made in defining the mailing are not retained within the system memory. If the response to the query at step 603 is "YES," then the method advances to the query at step 605. At step 605, the method queries as to whether or not the system operator wishes to continue with the setup process. If the response is "YES," then the method advances to step 613 where the system operator presses "CONT" to save the entries made and advance to the Estimated Cost screen at step 615 before advancing along path C16b to step 637 as shown in FIG. 5O.

Returning to step 605, if the response to the query at step 605 is "NO," then the method advances to step 607 where the system user presses "DONE" to save the current entries. Both steps 607 and 609, advance to step 611 where the system returns the user to the Main Menu.

Path C15 is shown re-entering the method flow at step 617 as shown in FIG. 5N. At step 617, the Outer Envelope—Graphics Layout screen is displayed within which is further displayed a graphical representation of the outer envelope. Essentially simultaneously to step 617, at step 619 the name of the mailing that is being created is displayed. The method advances to step 621 where the system user selects a bitmap envelope graphics file from among a pre-determined list of available files; from step 621, the method advances to step 623 where the desired height and width of the envelope graphic to be printed is selected. The graphic, now defined by file name and by desired size, is placed at step 625 in the desired location within the outer envelope graphic representation. From step 625, the method advances to a query at step 627.

At step 627, the method queries as to whether or not the system operator is done defining the mailing. If the response to the query is "NO," then the method advances to step 633 where the system user presses "CANCEL" and any entries made in defining the mailing are not retained within the system memory. If the response to the query at step 627 is "YES," then the method advances to the query at step 629. At step 629, the method queries as to whether or not the system operator wishes to continue with the setup process. If the response is "YES," then the method advances to step 637 where the system operator presses "CONT" to save the entries made and advance to the Estimated Cost screen at step 639 before advancing along path C16c to step 637 as shown in FIG. 5O.

Returning to step 629, if the response to the query at step 629 is "NO," then the method advances to step 631 where the system user presses "DONE" to save the current entries. Both steps 631 and 633, advance to step 635 where the system returns the user to the Main Menu.

The method now advances to step 637 as shown in FIG. 5O. Paths C16a, C16b, and 16C each terminate at step 637 where the costs for each of the items comprising the defined mailing are calculated before being displayed within their respective categories on the Estimated Cost Information screen in step 639. From step 639, the method advances to a query at step 641. At step 641, the method queries as to whether or not the initiating station or node is to receive a sample mail piece (verification copy) from the mailing to be conducted by the terminal location; that is, the location assembling and producing the mail job to be placed into the mail stream. If the response to the query is "NO," then the system advances to the query at step 647. If, however, the response to the query at step 641 is "YES," then the method advances to step 643 where the system user selects a "Verification" copy; the cost of the verification is displayed at step 645 within the Estimated Cost Information screen. The method then advances to the query at step 647.

At step 647, the method queries as to whether or not the initiating station or node is to receive a sample mail piece via fax (verification copy) from the mailing to be conducted by the terminal location. If the response to the query is "NO," then the method advances to step 651. If the response to the query at step 647 is "YES," then the method advances to step 649 where the system operator selects "Fax." After "Fax" is selected, the method advances to step 651 where the system displays any predetermined user notes or system disclaimers to the system user. The method then advances to a query at step 653.

At step 653, the method queries as to whether or not the system operator is done defining the mailing. If the response to the query is "NO," then the method advances to step 659 where the system user presses "CANCEL" and any entries made in defining the mailing are not retained within the system memory. If the response to the query at step 653 is "YES," then the method advances to the query at step 655. At step 655, the method queries as to whether or not the system operator wishes to continue with the setup process.

Figure 5P:
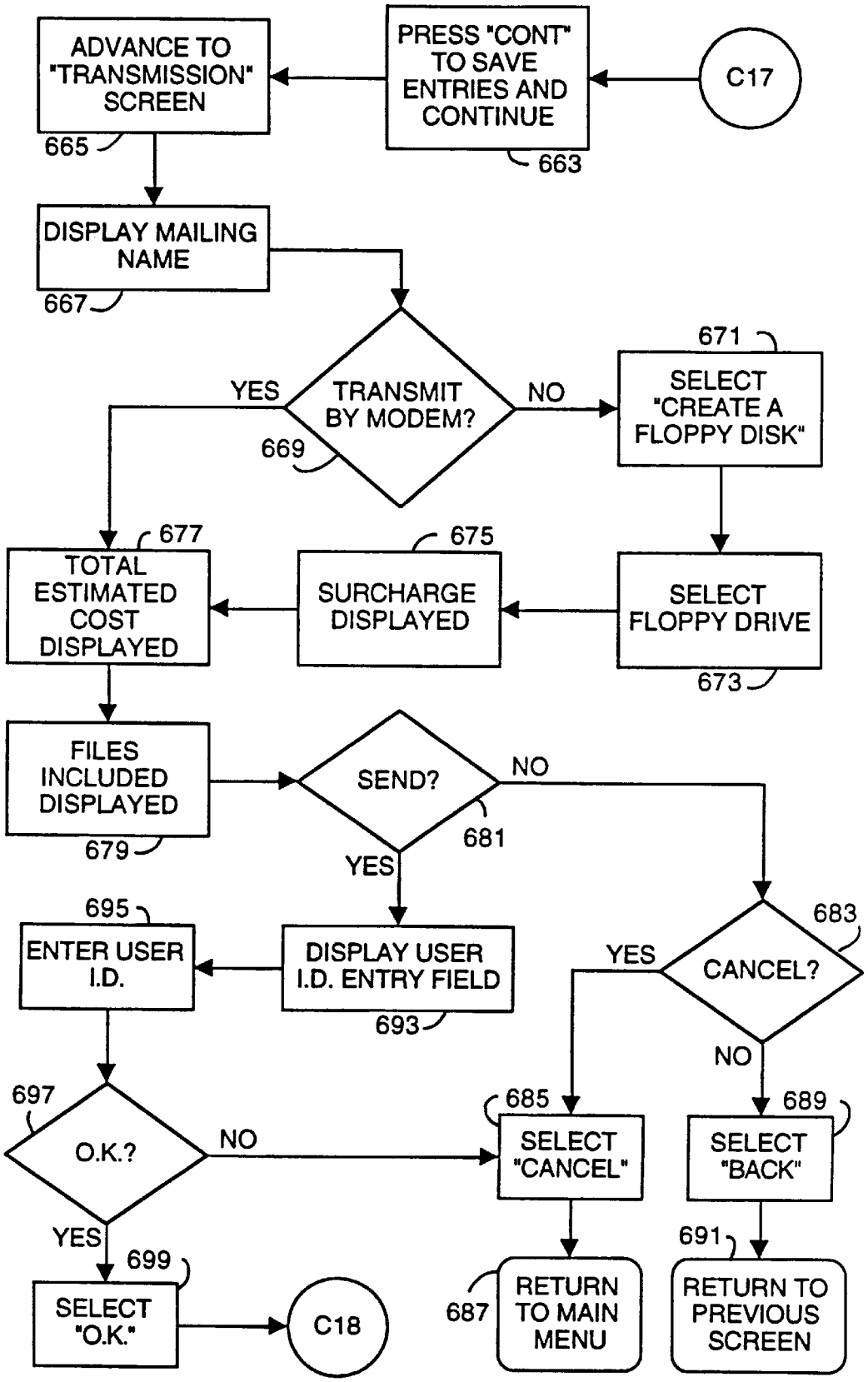

If the response is "YES," then the method advances along path C117 to step 663 as shown in FIG. 5P.

Returning to step 655, if the response to the query at step 655 is "NO," then the method advances to step 657 where the system user presses "DONE" to save the current entries. Both steps 657 and 659, advance to step 661 where the system returns the user to the Main Menu.

Turning to FIG. 5P, Path C17 re-enters the message flow at step 663 as shown. At step 663, the system operator presses "CONT" to save the entries made and advance to the Transmission screen at step 665. The Transmission screen is displayed and at step 667 the name of the mailing is displayed before the method advances to a query at step 669. At step 669, the method queries as to whether or not the established mailing parameters are to be sent to the terminal node via modem or similar communications link. If the response to the query is "YES," then the system calculates the total estimated cost of the mailing job and displays the cost on the Transmission screen at step 677. If the response to the query at step 669 is "NO," then the system operator selects "Create a Floppy Disk" at step 671, and then chooses, at step 673, the floppy drive (i.e. "a" drive, "b" drive, or other) where the available diskette is located. From step 673, the method advances to step 675 where any surcharge for accepting a floppy diskette is displayed. Step 675 advances to step 677 where the total estimated cost of the mailing is displayed.

In addition to displaying the total estimated cost of the mailing at step 677 the system displays, at step 679, the list of files that will comprise the mailing. From step 679, the method advances to a query at step 681. The query at step 681 inquires as to whether or not the mailing parameters of the now determined mailing job are ready to be transmitted. If the response to the query is "YES," then, at step 693, the system displays the User I.D. field. After display of the User I.D. field, the system operator enters a pre-determined user I.D. for the purposes of authentication at step 695 and then advances to a query at step 697. Returning to step 681, if the response to the query is "NO," then the method advances to a query at step 683.

At step 683, if the response to the query is "YES," then the method advances to step 685 where the system user selects "CANCEL" and any entries made in defining the mailing are not retained within the system memory. The method then returns the system user to the Main Menu at step 687. However, if the response to the query at step 683 is "NO," then the system user selects "BACK" at step 689 which returns the system user, at step 691, to the previous screen.

Figure 5Q:
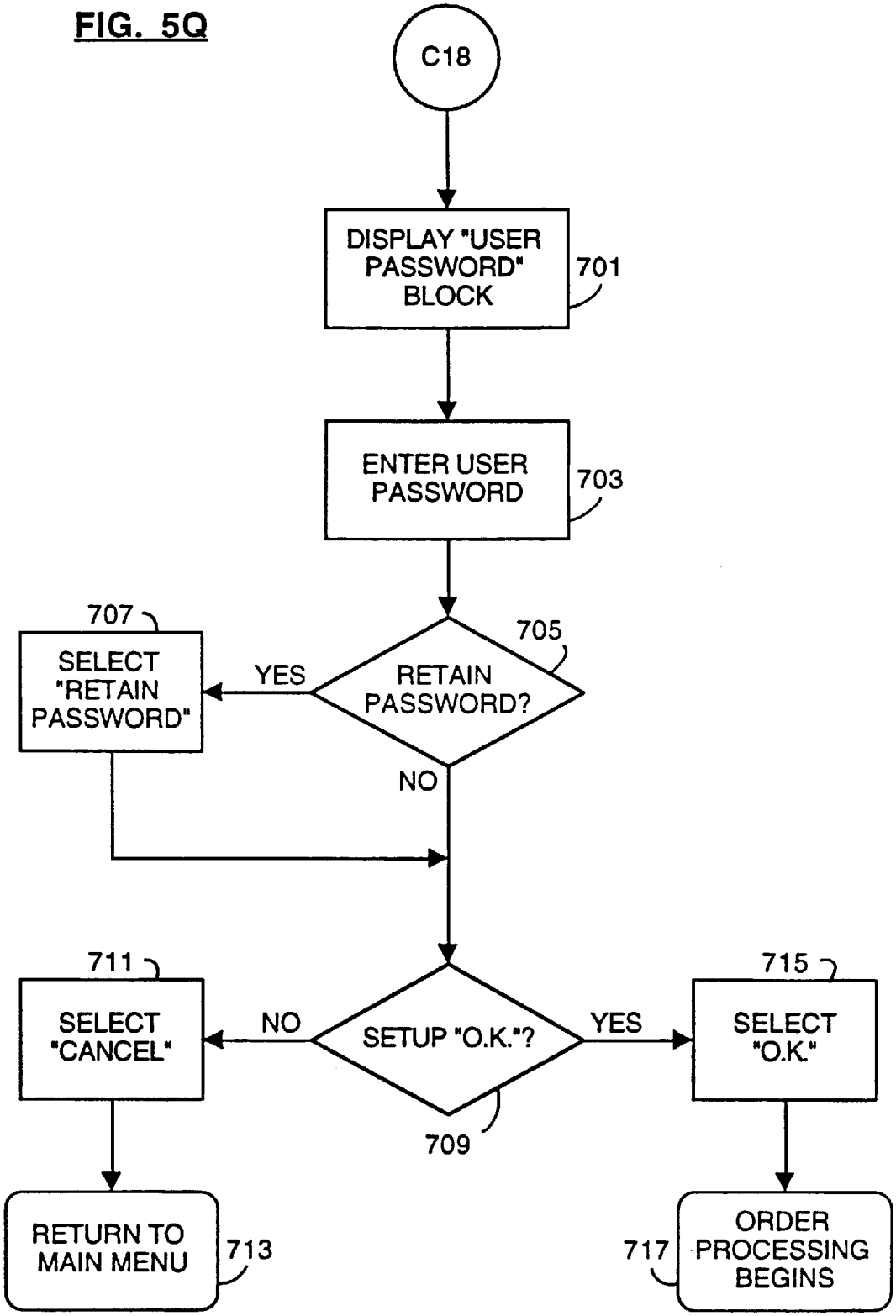

Returning to step 697, the method poses a query as to whether or not the entries or selections made are correct. If the response to the query is "YES," then at step 699 the system user selects "O.K." and the method advances along path C18 to step 701 as shown in FIG. 5Q. However, if the response to the query at step "NO," then the method advances to step 685 from which the flow is detailed above.

In FIG. 5Q, there is shown path C18 re-entering the method flow at step 701. At step 701, the system displays the User Password field. After display of the User Password field, the system operator enters a pre-determined user password for the purposes of authentication at step 703 and then advances to a query at step 705. At step 705, the system queries as to whether or not the system user wishes to retain the selected password. The system user would select a "YES" response to the query if the system user does not want to re-enter the password every time a mailing job order is being placed. If "YES" were selected, the method advances to step 707 and then the password would serve as a default until changed at step 703 during future use. Step 707 advances to a query at step 709; and, if the response to the query at step 705 is "NO," then the method will advance directly to the query at step 709.

At step 709, the system queries as to whether or not the set-up of the mailing order is "O.K." If the response is "NO," then the system user selects "CANCEL" at step 711 and the system will return the system user to the Main Menu at step 713. If, however, the response to the query at step 709 is that the set-up is "O.K.," then the user selects "O.K." at step 715 to begin the order transmission at step 717. Once selected, the system will establish communications with the next tier of the communications process, the mailing job will be placed with the terminal node as an order, and then the mailing will be processed as per the order parameters.

In FIG. 4, path D emanated from step 304 when it was determined that the system user wished to open an existing mail job parameter set. Path D re-enters the system flow at step 720 as is shown in FIG. 6.

At step 720, the system d isplays the "FILE MENU." The system user selects, at step 722, an "OPEN" option that allows the system user to open an existing mailing. Displayed for the system user at step 724 will be the Open A Saved Setting screen which displays all saved mailing jobs that can be opened. From step 724, the system advances to step 726 where a highlight bar is displayed and represents the currently selected mailing job. The highlight bar can be positioned or moved so as to select a desired mailing. When a file has been highlighted, the method queries at step 728 as to whether or not the system user wants to open the selected file. If the response to the query is "YES," then the system user selects "O.K." to open the selected file at step 730 and the Mailing Information screen is displayed at step 732. If the response to the query at step 728 is "NO," however, then the system user selects "CANCEL" at step 734 and returns to the main menu at step 736.

In FIG. 4, path E emanated from step 310 when it was determined that the system user wished to begin the sequence for deleting an existing mail job parameter set. Path E re-enters the system flow at step 750 as is shown in FIG. 7.

At step 750, the system displays the "FILE MENU." The system user selects, at step 752, a "DELETE" option that allows the system user to delete an existing mailing. Displayed for the system user at step 754 will be the Delete Mailing screen which displays all saved mailing jobs that can be deleted. From step 754, the system advances to step 756 where a highlight bar is displayed and represents the currently selected mailing job. The highlight bar can be positioned or moved so as to select a desired mailing. When a file has been highlighted, the method queries at step 758 as to whether or not the system user wants to delete the selected file. If the response to the query is "YES," then the system user selects "DELETE" to delete the selected file at step 760 and then advances to step 762. If the response to the query at step 758 is "NO," or if the selected file has been deleted, then the system user selects "CANCEL" at step 762 and returns to the main menu at step 764.

FIGS. 8A, 8B, 8C, 8D, and 8E detail the tiers of communication between an initiating node and a terminal node.

Figure 8A:
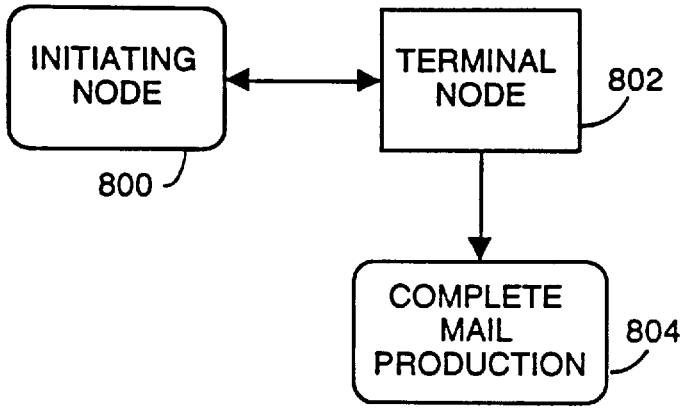
FIGS. 8A through 8E are flowcharts of the nodal paths as the paths increase in possible complexity due to interim relay points.

Turning to FIG. 8A, there is shown a communications path that is the most direct contemplated by the invention described herein; that is, where the initiating node and the terminal node are co-located. At step 800, a mailing job is defined by the system user at the initiating node. After the mailing job has been defined, the initiating node is in direct communication with the terminal node at step 802; it is the terminal node that will produce, at step 804, the mailing as defined at the initiating node. Co-location of the initiating and terminal nodes is possible where the system user defines the mailing job at the terminal node site (e.g., if an over-the-counter embodiment were contemplated where the system user were to utilize a counter service for placing the mailing job order).

Figure 8B:
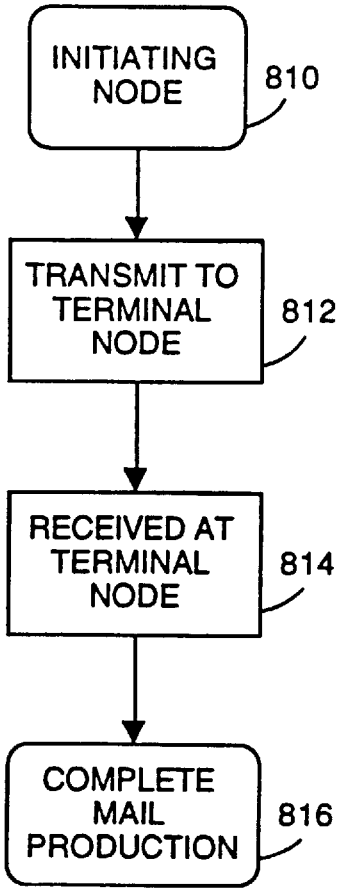

In FIG. 8B, there is shown a communications path where the initiating node is in direct communication with the terminal node, but the initiating and terminal nodes are in separate locations. At step 810, the initiating node would define the mailing parameters and transmit those parameters to the terminal node at step 812. At step 814, the terminal node would receive the mailing job, parse the instructions and then set-up the mailing for production. The method would complete the mailing production at step 816.

Figure 8C:
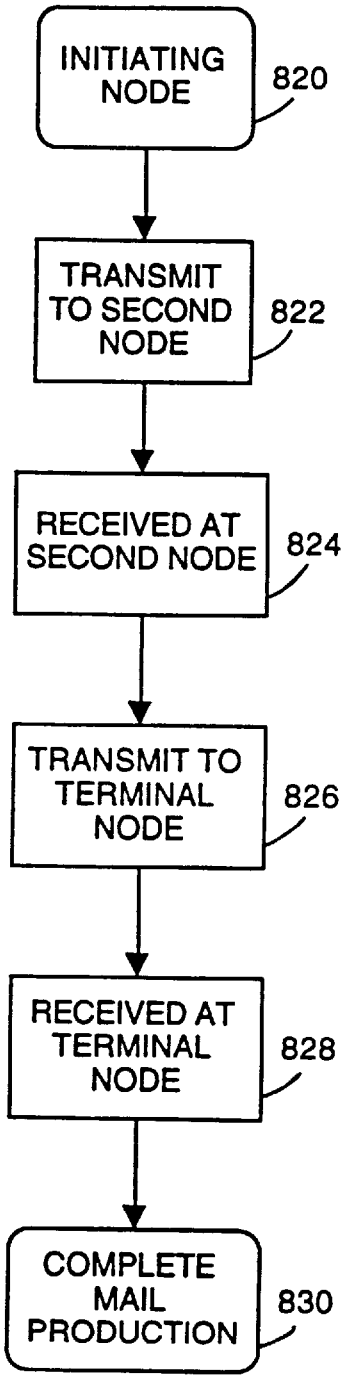

FIG. 8C takes the communications path of FIG. 8B and adds an additional layer of processing. The value to an additional layer is in the presence of a back-up system, either for redundancy in case of a malfunction at one level; or, simply to have regional locations receive communications from outlying districts for retransmission to a central hub. The latter would allow mailings to be produced at locations closer to the mail destination points or simply allow cost efficiencies to be added by re-routing communications.

In FIG. 8C, the initiating node would define the mailing parameters at step 820 and transmit those parameters to an intermediate node at step 822. The intermediate receives the transmission of the mailing job parameters at step 824 and re-transmits the parameters to the terminal node at step 826. At step 828, the terminal node receives the mailing job, parses the instructions and then sets up the mailing for production. The method and system would complete the mailing production at step 830.

Figure 8D:
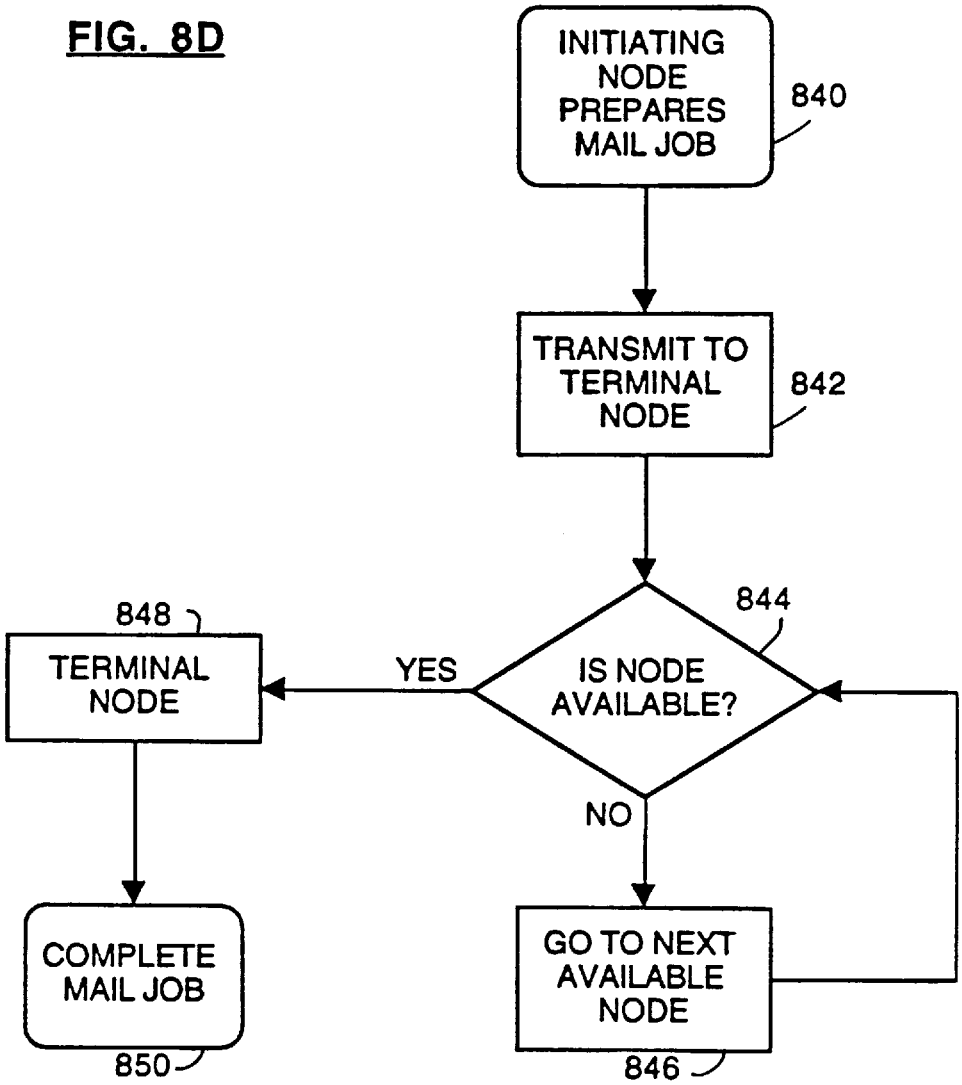

FIG. 8D utilizes the efficiencies of the FIG. 8C embodiment, but expands the possibilities available for selection of a terminal node by backing up the terminal node with an alternative routing if the intended terminal node is either busy, off-line, or not geographically suitable. In this embodiment, the decision not to utilize the intended terminal node is made by the intended terminal node. The transmission is then routed to the next available terminal node available from a pre-determined list of available nodes.

In FIG. 8D, the initiating node would define the mailing parameters at step 840 and transmit those parameters to the terminal node at step 842. The terminal node receives the transmission of the mailing job parameters at step 844 and poses a query as to whether or not the designated terminal node is prepared to produce the defined mailing. If the response to the query is "NO," then the terminal node will send the transmission, at step 846, to the next available terminal node that is listed on a pre-determined list of available terminal nodes. The method thus returns to step 844 to query if the newly designated terminal node is available. If the next terminal node on the list is not available, then the system will attempt to transmit to each node listed until the list has been exhausted. If communication has been attempted to each node on the list of available nodes and a completed transmission of the mailing parameters has not occurred, then it is a matter of network preference as to whether or not the system will continue to cycle through the list making attempts at transmission or, whether the system will simply indicate back to the initiating node that the transmission was unsuccessful.

Returning to the query at step 844, if the response to the query is "YES," then the method would advance to step 848 where the terminal node receives the mailing job, parses the instructions, and then sets up the mailing for production. The method and system complete the mailing production at step 850.

Figure 8E:
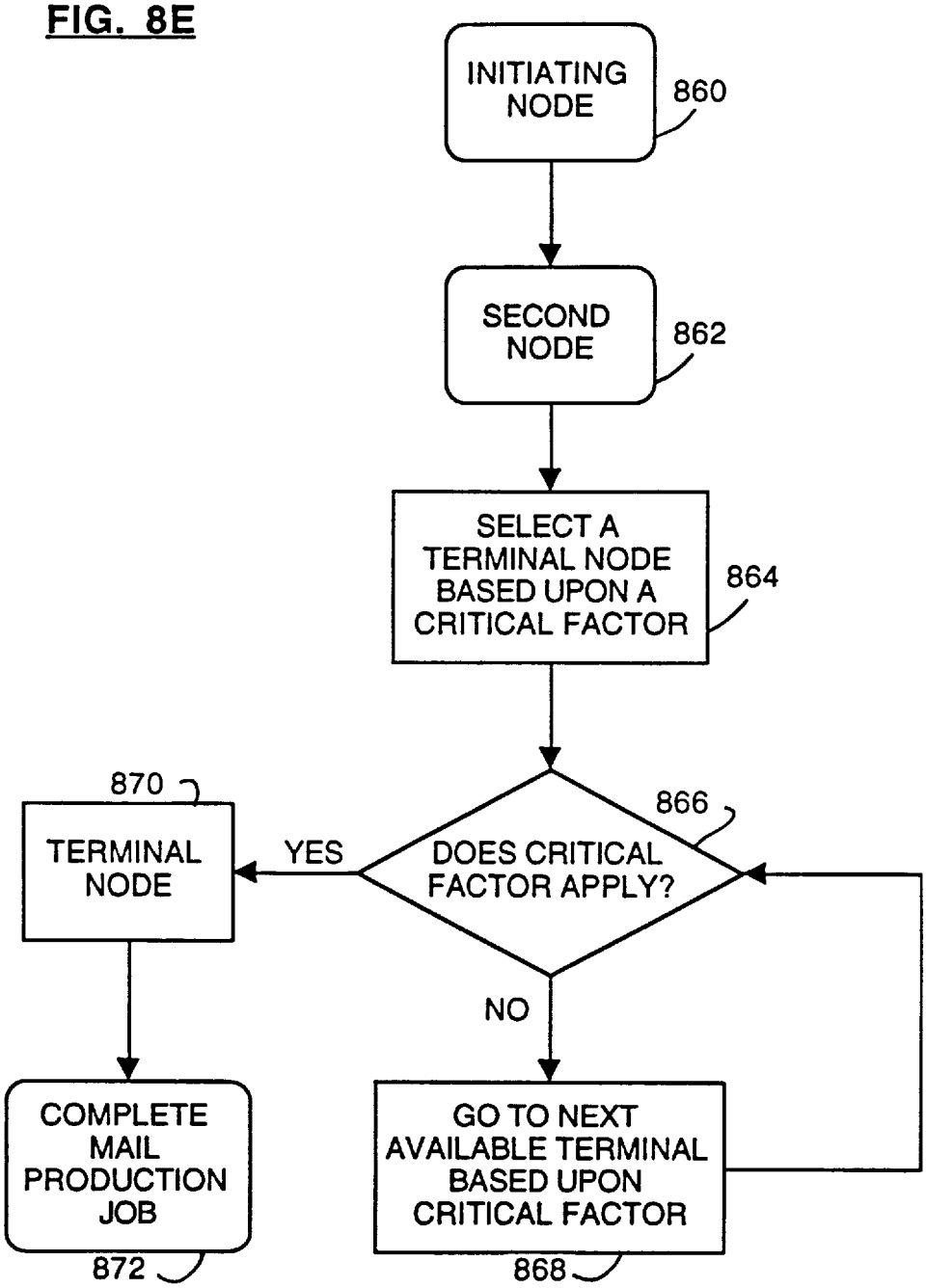

FIG. 8E utilizes the efficiencies of the FIG. 8D embodiment, but expands the possibilities available for selection of a terminal node by establishing a server location that allows the system to select optimal routing of the mailing job based upon at lease one set of critical factors. In this embodiment, the decision of which terminal to utilize is made at an intermediate node based upon a selection from a list of terminal nodes available and further based upon at least one critical factor such as geographic location, availability of resources, location vis-a-vis mailing destination, localized billing requirements, or any from a long list of possible choices defined by business, technological, or legal needs. The transmission is then routed by the second node to the optimal terminal node available from the pre-determined list of available nodes.

In FIG. 8E, the initiating node would define the mailing parameters at step 860 and transmit those parameters to an intermediate node at step 862. The intermediate node receives the transmission of the mailing job parameters at step 862 and then selects at step 864 a terminal node based upon a critical factor (i.e. geographic location) in light of a pre-determined list of available terminal nodes. From step 864, the method advances to step 866 and poses a query as to whether or not the designated terminal node is prepared to produce the defined mailing. If the response to the query is "NO," then the terminal node will send the transmission, at step 868, to the next available terminal node (qualifying node) that is listed on a pre-determined list of available terminal nodes and that meets the pre-determined critical factor. The method thus returns to step 866 to query if the newly designated terminal node is available. If the next terminal node on the list is not available, then the system will attempt to transmit to each qualifying node listed until the list has been exhausted. If communication has been attempted to each node on the list of qualifying nodes and a completed transmission of the mailing parameters has not occurred, then it is a matter of network preference as to whether or not the system will continue to cycle through the list making attempts at transmission or, whether the system will simply indicate back to the initiating node that the transmission was unsuccessful.

Returning to the query at step 866, if the response to the query is "YES," then the method advances to step 870 where the terminal node receives the mailing job, parses the instructions, and then sets up the mailing for production. The method and system complete the mailing production at step 872.

It should be noted that with the possibilities available in networking facilities, it is entirely within the capabilities of the method and system to have variations of the communications paths illustrated by FIGS. 8A–8E wherein several embodiments as described may exist within a particular network.

As can be appreciated by those skilled in the art, a number of variations of the subject invention are possible. These variations include mailing machine 40 which can be further comprised of a number of elements which include: a meter linking device connected to a microprocessor; a weighing scale connected to the microprocessor; a postage meter connected to the meter linking device by an echoplex interface cable; and, a mailing base connected to the digital input/output card by an interface cable. The mailing base can be of a kind that is remotely tripped by a mail piece passage; such bases are known and are developed and marketed by Pitney Bowes Inc. of Stamford, Conn., who is the assignee of the present invention. The cited meter linking device allows a host data processing system to remotely control the postage meter, or known devices such as parcel registers, scales, or mailing machines. An example of a meter linking device is MeterLink which is developed and marketed by Pitney Bowes Inc. of Stamford, Conn., who is the assignee of the present disclosed invention.

Further variations of the subject invention include: the number and configuration of nodes available in the system; the system's ability to utilize default settings for any of the configuration parameters; the interconnection of memory 20, or of modem 22, to microprocessor 12 can be accomplished effectively in any of several embodiments that include: hardwiring, plug-in/plug-out interconnection, or operative interconnection through more than one element; the types of microprocessors available for data processing; the range of printer types available for print production; and, the range of media available for printing.

What is claimed is:

1. A method of defining and producing a finished mail piece, comprising the steps of:

(a) selecting at a first node, a plurality of characteristics which together define a mailing;

(b) creating a document and storing said document in electronic form; then directing that said stored document be included in a print job comprising said mailing;

(c) creating an address list comprising one or more destination addresses and storing said address list in electronic form and then selecting said stored address list for inclusion in said print job;

(d) transmitting said print job to a terminal node wherein said terminal node is not co-located with, nor under the control of, said first node;

(e) receiving said print job at said terminal node; said terminal node for receiving said print job and for directing said print job to a mail production means for producing said mail piece; said mail production means further comprising:

(i) a first printer; and (ii) a second printer;

(f) printing on said first printer said destination address to an envelope wherein each of said destination addresses is printed to a corresponding envelope;

(g) printing on said second printer said document, wherein said document is printed in accordance with characteristics selected at said first node;

(h) inserting said printed document into said printed envelope to form an unfinished mail piece;

(i) sealing said unfinished mail piece;

(j) franking said unfinished mail piece, in accordance with characteristics selected at said first node and with characteristics determined at said second node, in order to form a finished mail piece; and (k) placing said finished mail piece into a mail stream for delivery to said destination address printed thereon.

2. The method of claim 1, wherein said plurality of characteristics comprises:

(a) a choice of paper, said choice further comprising:

(i) a choice of ink color;

(ii) a choice of paper color;

(iii) a choice of paper size;

(b) a choice of duplex or simplex printing on said chosen paper;

(c) a choice of whether or not a reply envelope is to be printed; and (d) a choice of how said chosen paper is to be folded.

3. The method of claim 1, wherein said each of said destination addresses comprising said stored address list is compared to a predetermined database of correct addresses wherein each address is matched with a corresponding zip code; and, if said each of said destination addresses does not match said correct address then said non-matching address is corrected to match said correct address.

4. The method of claim 1, wherein duplicate destination addresses contained on said stored address list are detected by parsing address data contained within each of said destination addresses and to form a file, and then matching each of said files to determine whether any of said files duplicates another of said files.

5. The method of claim 1, wherein a receipt indicative of said print job and delivery into said mail stream is generated by said terminal node and transmitted to said first node.

6. The method of claim 1, wherein said first printer and said second printer are co-located within a single apparatus.

7. The method of claim 6, wherein said apparatus is a mailing system comprising:

(a) a data processor;

(b) a document printer;

(c) an envelope printer;

(d) a postage meter; and (e) an inserter.

8. The method of claim 1, wherein said terminal node is the next consecutive node after said first node.

9. The method of claim 8, wherein said first node selects said terminal node from among a plurality of terminal nodes.

10. The method of claim 9, wherein said first node selects said second node as determined by said second node being a first available terminal node in accordance with a predetermined order of terminal nodes.

11. The method of claim 1, wherein a second node receives said print job and distributes said print job to said terminal node for production of said finished mail piece.

12. The method of claim 11, wherein said second node receives said print job and distributes said print job to one of a plurality of terminal nodes for production of said finished mail piece.

13. The method of claim 12, wherein said second node makes said distribution based upon the availability of said terminal node.

14. The method of claim 12, wherein said distribution is determined by the location of said terminal node.

15. A system for producing a mail piece comprising:

(a) first data processing means for selecting a document, selecting an address list, and selecting a plurality of characteristics which together define a mailing;

(b) transmission means for transmitting said mailing to a second data processing means wherein said second data processing means is not co-located with, nor under the control of, said first data processing means;

(c) second data processing means for receiving said mailing and downloading said mailing to a plurality of printer means comprising a first printer and a second printer;

(d) first printer means comprising said first printer for printing addresses from said address list to envelopes;

(e) second printer means comprising said second printer for printing said document to media selected at said first data processing means;

(f) inserter means for inserting said printed documents into said envelopes to form an unfinished mail piece;

(g) sealing means for sealing said unfinished mail piece; and (h) franking means for franking said unfinished mail piece to form a finished mail piece.

16. The system of claim 15, wherein said second data processing means, said second printer means, said inserter means, said sealing means, and said franking means comprise a single apparatus.

17. The system of claim 15, wherein said first printer means and said second printer means are co-located.

18. The system of claim 15, wherein said system further comprises a plurality of nodes wherein one node is an initiating node and a second node is a terminal node; and, if there are more than two nodes in said system, then said first and said second printer means are located at said terminal node.

19. The system of claim 15, wherein a second node relays said mailing from said first data processing means to said terminal node.

* * * * *